US007752810B2

(12) United States Patent
Haab et al.

(10) Patent No.: US 7,752,810 B2
(45) Date of Patent: Jul. 13, 2010

(54) DEVICE FOR SUPPORTING DISPLACEABLE SEPARATION ELEMENTS

(75) Inventors: Gregor Haab, Baar (CH); Cornel Füglistaller, Jonen (CH); Stefan Hagger, Boppelsen (CH); Reto Beck, Emmenbrücke (CH)

(73) Assignee: HAWA AG, Mettmenstetten (CH)

( * ) Notice: Subject to any disclaimer, the term of this patent is extended or adjusted under 35 U.S.C. 154(b) by 0 days.

(21) Appl. No.: 11/575,497

(22) PCT Filed: Sep. 9, 2005

(86) PCT No.: PCT/CH2005/000541

§ 371 (c)(1),
(2), (4) Date: Dec. 24, 2007

(87) PCT Pub. No.: WO2006/032157

PCT Pub. Date: Mar. 30, 2006

(65) Prior Publication Data

US 2008/0209813 A1 Sep. 4, 2008

(30) Foreign Application Priority Data

Sep. 20, 2004 (CH) ..... 1534/04

(51) Int. Cl.
*E05D 13/00* (2006.01)

(52) U.S. Cl. ..... 49/409; 49/404

(58) Field of Classification Search ..... 49/404, 49/409, 324, 360, 125, 127, 128
See application file for complete search history.

(56) References Cited

U.S. PATENT DOCUMENTS

| | | | | |
|---|---|---|---|---|
| 1,881,014 | A | 10/1932 | Ayer | |
| 3,195,192 | A * | 7/1965 | Neisewander | 49/127 |
| 4,698,876 | A * | 10/1987 | Karita | 16/102 |
| 5,577,348 | A * | 11/1996 | Keller | 49/317 |
| 5,712,516 | A * | 1/1998 | Kabout | 310/12 |
| 6,799,393 | B2 * | 10/2004 | Stephen | 49/118 |
| 2002/0050801 | A1 | 5/2002 | Wood et al. | |
| 2003/0110696 | A1 * | 6/2003 | Rennetaud et al. | 49/120 |
| 2005/0235567 | A1 * | 10/2005 | Finke | 49/360 |
| 2008/0100152 | A1 * | 5/2008 | Busch | 310/14 |

FOREIGN PATENT DOCUMENTS

| | | | |
|---|---|---|---|
| DE | 40 16 948 | A1 | 11/1991 |
| EP | 1197624 | | 4/2002 |
| GB | 1 089 605 | A | 3/1991 |
| WO | 2004/005656 | A1 | 1/2004 |

* cited by examiner

*Primary Examiner*—Katherine W Mitchell
*Assistant Examiner*—Catherine A Kelly
(74) *Attorney, Agent, or Firm*—Shalom Wertsberger; Saltamar Innovations

(57) ABSTRACT

The invention relates to a device for supporting a displaceable separation element (3), in particular a sliding door. Said device comprises a carriage (1), which is guided in a rail (2), equipped with a carriage body (10) and mechanically mounted in the rail (2) by means of rollers (8) or at least one sliding element (11; 110). The rail comprises a central part (2') and two lateral parts (2"), which are equipped with opposing rail feet (21) that mechanically support the carriage (1). According to the invention, the carriage body (10) is provided with at least one hard magnetic magnet (12, 120), which exerts a force on at least one of the rail magnets (22, 22', 22", 220, 2200) that is connected to the rail (2), said force acting in opposition, preferably in an axially parallel manner, to the gravitational force exerted by the separation element (3) on the carriage (1).

21 Claims, 13 Drawing Sheets

Fig. 8
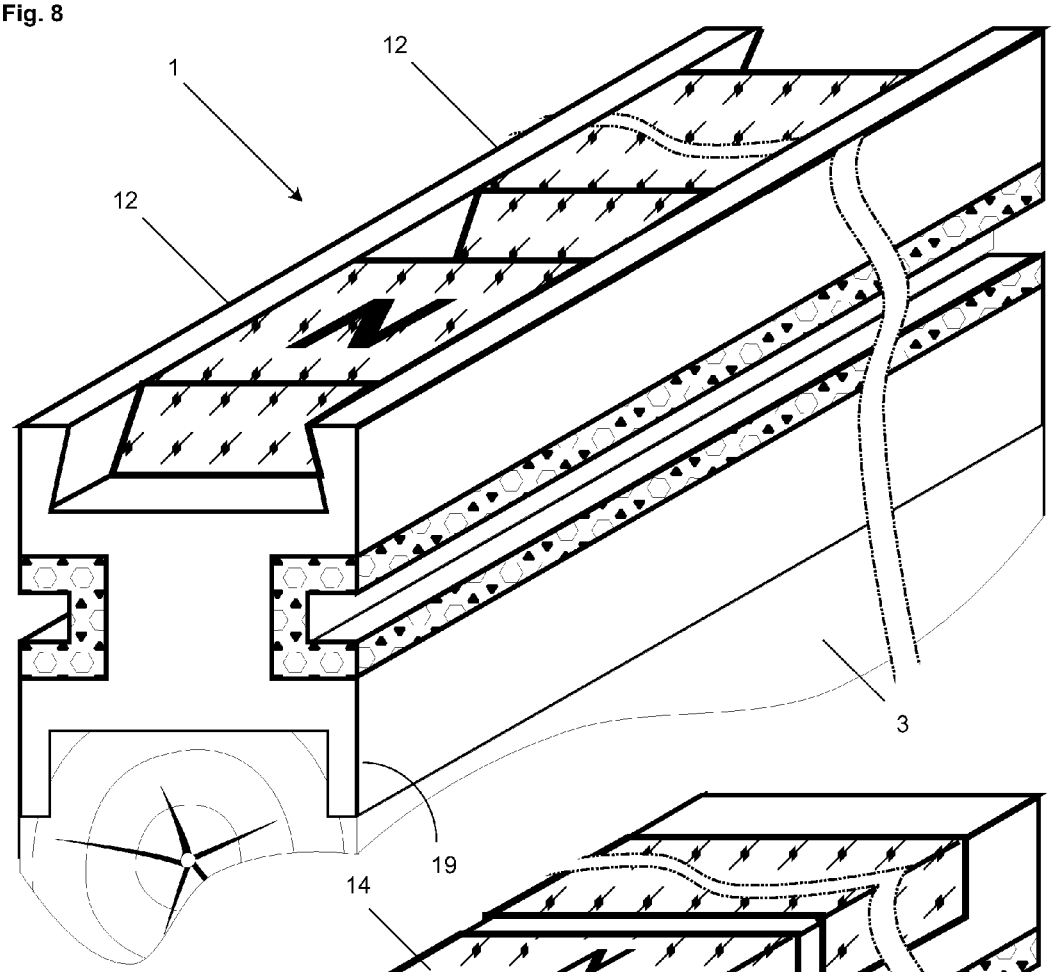
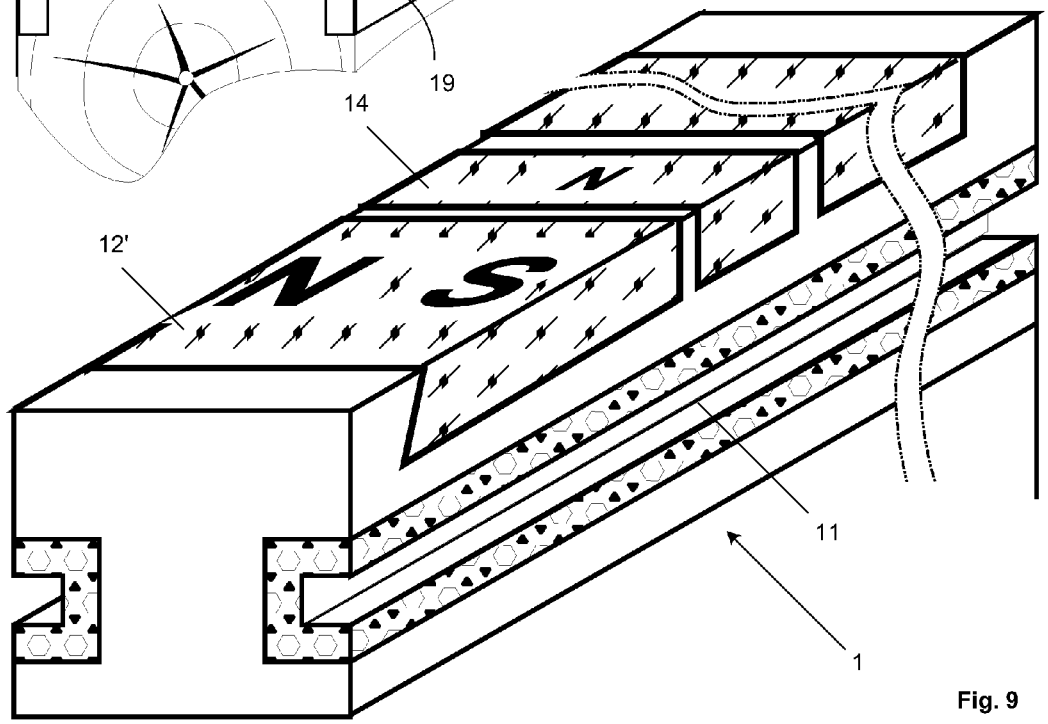
Fig. 9

2
22
21
2100
32
113
110
28
111

10O
h
10U
110U; 110L, 110R
111
111S
110
13
18
12
1
10

11
13
18
12
191
10
190
129
S
N 2
22
28
21
2100
110
B
32
B
181
18
10
12
1

Fig. 17
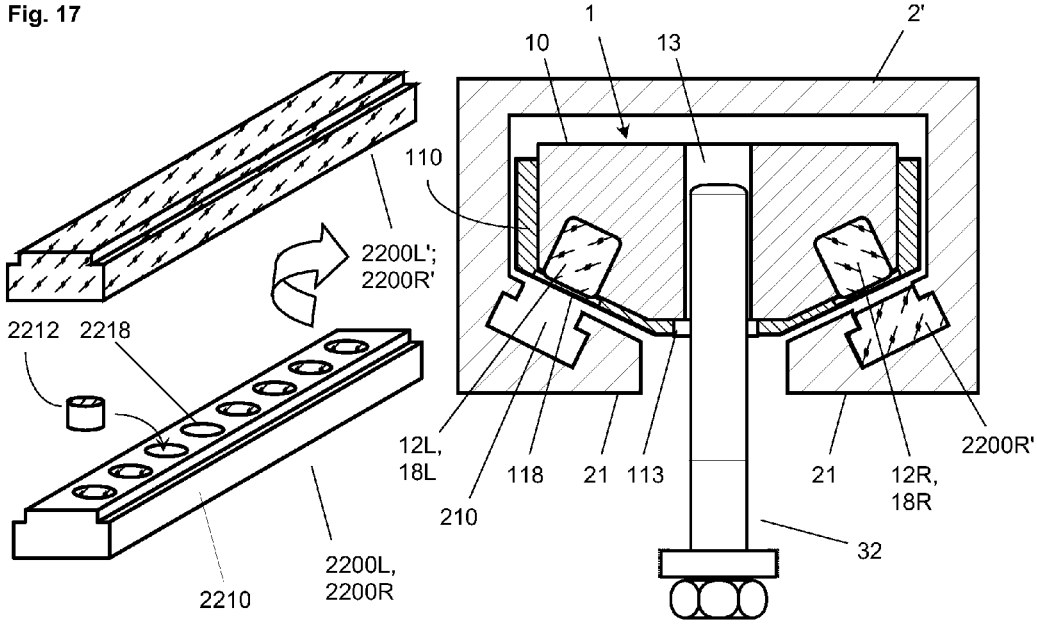
Fig. 18
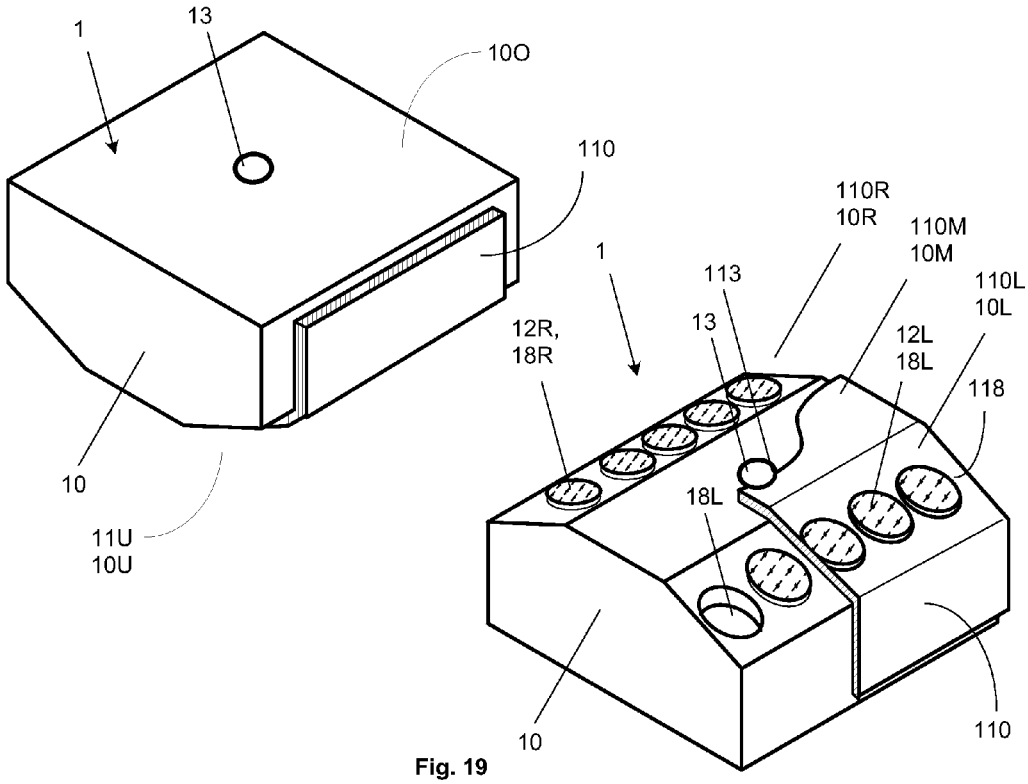
Fig. 19

A
A
d
1,2 d
d
1
2
8
10
10O
10U
12
13
18
21
22
28
32
80
81
82
130
181
182
185
188
190
1850
180
2100

DEVICE FOR SUPPORTING DISPLACEABLE SEPARATION ELEMENTS

The invention relates to a device for supporting displaceable separation elements, in particular sliding doors, sliding shutters or windows, according to the introductory clause of claim 1.

Separation elements which serve for closing off and/or dividing areas are normally suspended on a carriage which is guided in a rail, as shown below in FIG. 34.

Figure 34:
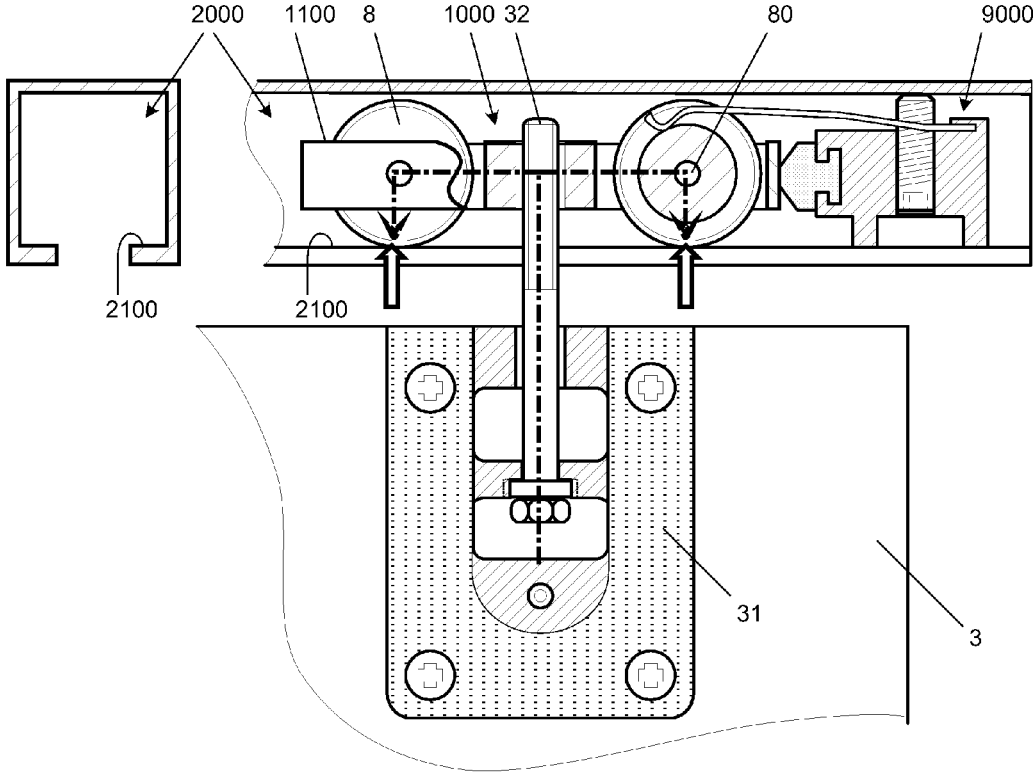

FIG. 34 shows a rail 2000 represented in section, in which a carriage 1000 is guided that is connected by means of a connecting screw 32 to a fixing device 31, which holds a separation element 3. The carriage 1000, which comprises a carriage body 1100 and two wheels 8 rolling on running surfaces 2100 of the rail 2000 and mounted by means of shafts 80, is located on the right stop of the running path formed by a buffer device 9000. It can be seen from FIG. 34 that the gravitational forces exerted by the separation element 3 are transmitted via the connecting screw 32, the carriage body 1100, the shafts 80 and the wheels 8 along a line, on which each of the wheels 8 are arranged, onto the running surfaces 2100 of the rail 2000.

On account of the often very high gravitational forces of the separation elements 3 said parts of the carriages 1, in particular the wheels 8, are to be formed suitably, i.e. produced from suitable material and dimensioned accordingly. On account of the high gravitational forces, after a fairly long duration of operation, wear of the parts of the carriages 1000 may still arise, whereby running noise of the carriages 1000 can significantly increase.

With the technology described for supporting displaceable separation elements, there are thus the following disadvantages. Relatively large carriages are required which can only be used in rails with correspondingly large inner dimensions. On account of the point-by-point transmission of high forces, relatively great wear and disruptive running noise can result. The latter disadvantages appear increasingly with travel around curves. In order to achieve travel around curves with small radii of curvature it has therefore already been proposed that carriages should be used with only one wheel which does, however, carry a correspondingly higher load.

Mechanical wear of parts of the device can however be avoided if the held separation element, for example a door leaf, is supported so as to be suspended in a contact-free way by means of cooperating magnets, as described in [1], DE 40 16 948 A1. With this solution, however, a costly and voluminous construction results, in which many special parts are needed. Standard parts however, such as conventional rails, cannot be used. This problem of the complex magnetic bearing technology is one of the reasons that this technology has not yet been successfully implemented in this field of technology, particularly in view of the known price trends.

From [2], US 2003/0110696 A1 a device for suspending a lift door is known, in which elements serving for the magnetic support of the door are completely separated by a plate 3 from elements serving for the mechanical support of the door, which is why a voluminous and correspondingly complex solution results with many special construction elements.

A further device for the magnetic support of a displaceable separation element is known from [3], GB 1 089 605 A, which is designed exceptionally complex and voluminous and can scarcely be used in practice.

It is thus an object of the present invention to create an improved device for supporting displaceable separation elements.

In particular, a device is to be created for supporting displaceable separation elements which can be realised in smaller dimensions and which operates practically wear-free and noise-free.

Furthermore, it should be possible to use conventional construction elements for this device in a simple way so that the inventive device can easily and cost-effectively be produced and assembled.

This object is achieved with a device that comprises the features defined in claim 1. Advantageous embodiments of the invention are defined in further claims.

The device which serves for supporting a displaceable separation element, in particular a sliding door or a window, comprises a carriage provided with a carriage body that is guided by means of a rail and that is mechanically supported within the rail by means of rollers or at least one sliding element. Said rail comprising a central part and two lateral parts, on which opposing rail feet are provided that serve for the mechanical support of the carriage.

According to the invention the carriage body is provided with at least one hard-magnetic carriage magnet which exerts a force on at least one ferromagnetic, possibly hard-magnetic rail magnet connected to the rail, said force working preferably in an axially parallel way against the gravitational force exerted by the separation element on the carriage.

The term "rail magnet" includes ferromagnetic materials of any type insofar as they have the necessary permeability. A noticeable remanence is not necessary as the magnetic effect is provided by the at least one, permanently hard-magnetic carriage magnet 12.

The rolling or sliding elements serving for the mechanical support are therefore subjected to a reduced load during the operation of the carriage, thus resulting in a prolonged product life of the mechanical support elements, reduced maintenance efforts and reduced running noise. On account of the reduced load the mechanical support elements can be built more cost-effectively and realised in smaller dimensions. Furthermore, a reduced frictional resistance results, which is why the necessary driving force is correspondingly reduced.

It is particularly advantageous that known rails can be used with small cross-sections, possibly only with negligible profile adaptations, and known rolling and sliding material, with the result that the invention can be realised simply and cost-effectively. The invention therefore constitutes an optimal combination of the technologies of mechanical support and magnetic support, meaning that these technologies can advantageously be implemented not only in a simple, space-saving and cost-effective way but also in operational terms.

With the choice of high-quality magnetic elements and corresponding materials the load of the mechanical support elements can be reduced to a minimum. In recent years increasingly efficient materials have been found and alloys have been developed such as ferrite, AlNiCo, SmCo, NdFeB. Furthermore, plastic-bonded magnets have been developed.

The carriage and rail magnets are arranged in such a way that they exert an attractive force or (only when using hard-magnetic rail magnets) repulsive force on one another. An attractive force which is normally sufficiently large is achieved cost-effectively in that a ferromagnetic, typically soft magnetic rail magnet cooperates with the carriage magnet. In this arrangement there are no pole transitions during the displacement and therefore no disruptive force influences which could cause a rough course of the separation element.

A larger mutual attractive force can be achieved with higher expense in that a hard-magnetic rail magnet is used with corresponding pole orientation. However, it is thereby provided that the magnetic force never fully compensates the force of the load in such a way that the mechanical support is always operational.

Insofar as the rail magnet(s) is/are arranged above the carriage, the latter is pulled upwards and remains there only on account of the force which is preferably a quarter higher exerted by the separation element on the carriage, in association with the rail.

When using hard-magnetic carriage magnets and hard-magnetic rail magnets, a repulsive force can be achieved that can advantageously be used. Insofar as the rail magnet(s) is/are arranged with corresponding polarity orientation below the carriage, the latter is pushed upwards and remains there, once again only on account of the greater force which is exerted by the separation element on the carriage, in association with the rail.

In order to achieve an attractive force at least one pair of unlike magnetic poles lie opposite one another or a high-permeability, preferably ferromagnetic rail magnet is used which connects the magnetic poles differently formed on the carriage body and the carriage magnets to one another, whereby the polar axes are preferably aligned vertically or inclined or aligned horizontally. In order to achieve a repulsive force at least two pairs of like magnetic poles lie opposite one another other, whereby the polar axes may be arranged vertically or preferably inclined in relation to one another in such a way that a magnetic force vector results which extends anti-parallel to the load vector. With the inclination of the polar axes the carriage is automatically centred and orientated.

By the orientation of the magnetic axes of the carriage and rail magnets perpendicularly to the gravity axis of the separation element and perpendicularly to the plane defined by the separation element, both pairs of poles of the magnets can be arranged so as to lie close to one another, meaning that smaller dimensions of the carriage and the rail are achieved. Furthermore, particularly with this arrangement, plastic-bonded magnets, for example in the form of strips, can be advantageously used. It should further be taken into consideration that with this arrangement of the magnetic elements the magnetic circle is almost exclusively formed by the magnetic elements, meaning that a great force effect is achieved. On account of the pairs of poles spaced apart from one another a stabilisation of the carriage and a further reduction of the load on the mechanical support also result. Insofar as the carriage magnets and/or the rail magnets are continuously magnetised strips, pole transitions and thus a jerky course of the separation element can be avoided. The strips can further contain merely high-permeability, preferably ferromagnetic materials which cooperate with the carriage magnets.

For the carriage magnets, possibly also for the rail magnets, cup-shaped, pill-shaped or cylindrical, hard-magnetic round magnets are preferably used, which have very good magnetic properties over the whole volume and can be easily assembled. By embedding a round magnet in a correspondingly adapted cylindrical recess of the carriage body which serves as a flux return plate, the pole sunk into the recess is connected via the negligibly small magnetic resistance of the carriage body annularly and concentrically with the second pole to the surface of the carriage body, in such a way that an optimal interaction is achieved with a ferromagnetic or hard-magnetic rail magnet which either connects the two poles of the carriage magnet existing on the surface of the carriage body to one another magnetically or to its unlike or like magnetic poles in order to achieve the desired attractive or repulsive force. The contact points in the recess of the carriage body are geometrically adapted to the adjacent pole of the carriage magnet and preferably surface-tempered and/or metallically refined in order to ensure a surface which is as far as possible smooth and/or corrosion-resistant, to which surface the adjacent magnetic pole can be optimally connected The attractive force can be advantageously achieved in that the rail magnet(s) is/are arranged above the carriage at the middle part of the rail preferably on retaining ribs and the carriage magnets are arranged on the upper side of the carriage body.

The repulsive force can be advantageously achieved in that the rail magnet(s) can be integrated below the carriage into the rail feet and the carriage magnets are arranged on the lower side of the carriage body.

Insofar as the carriage is mounted so as to be suspended, i.e. so as to be rotatable and displaceable, particularly in order to realise travel along a curve in curved or bent rails, it is preferably held in a central position by means of guide magnets (see also commentary regarding FIG. 33, in which the guiding function through the carriage and rail magnets is described), which are for example arranged on the lateral parts of the rail in such a manner that their magnetic axes extend parallel or perpendicularly to the magnetic axis of carriage magnets corresponding thereto, whereby at least one pair of like magnetic poles lie opposite one another in each case.

In a further preferred embodiment, a plurality of inventive carriages are coupled to one another by means of coupling elements in such a way that the load of the separation elements is distributed evenly on the carriages. For example the carriages are provided with elastically supported elements which can only be displaced vertically and which are connected with a coupling axis. A load acting on the coupling axis therefore causes identical deflections of the displaceable elements.

In order to realise travel along curves a single-axis carriage can further be used which is connected on both sides by means of flanges and preferably magnetic coupling elements to at least one respective single-axis carriage element in such a way that the carriage and carriage elements which share the load of the separation element and pass it on via carriage and rail magnets can only rotate in one plane.

The connection of the rail magnets to the rail or to the carriages can take place by means of fixedly provided or mountable retaining elements, for example retaining ribs provided on the lateral parts of the rail or by means of adhesive. Preferably, recesses for receiving the magnetic elements are provided which can be locked for example with the aid of preferably non-magnetic locking elements. Plastic-bonded elastic magnets, including high-energy magnets bonded in plastic, can therefore be quickly and simply laid and fixed in the recesses and possibly be exchanged at a later point in time. Insofar as the hard magnets are installed in recesses of the carriage body, they are held there in a self-acting way.

In order to allow optimisation of the device and a reduction in the air gap between the magnetic elements, the latter can be supported so as to be displaceable. In particular it is advantageous to mount the carriage magnet(s) provided on the carriage so as to be vertically displaceable. For this purpose the carriage magnets can be supported in the recesses in the carriage body by screw bolts or even be provided themselves with a thread.

In order to change the magnetic force effect it is further possible to provide on the carriage body T-profile-shaped retaining grooves extending longitudinally or transversely, into which one or more rail magnets can be introduced in the desired number.

In further preferred embodiments the carriage and/or the rail is/are provided with at least one coil, by means of which magnetic fields of the magnetic elements are detected on passing by them and converted into electric currents which can be used for charging an accumulator, or for supplying power to a control unit, or for determining the position or the movement, or for the acceleration or speed of the separation element.

By means of the control unit, for example a switch lying parallel to the coil and/or a variable resistor lying parallel to the coil or a braking unit can be actuated in order to influence the course of the separation element or even to stop it and lock it. For example the switches connected to coils are closed if the separation element is in the region of the end position insofar as the latter has a speed which is too high. After falling below a minimum speed they are for example opened again, so as not to hinder the slow passage into the end position.

In a preferred embodiment an optical output unit and/or an acoustic output unit can be actuated by means of the control unit in order to signal the travel of the separation element and to avoid collisions.

Preferably, an electric lock can further be actuated by means of the control unit, for example as soon as the end position is reached.

Data which relate to the status, the movement and/or the position of the separation element can be transmitted by the control unit preferably in a wireless or wired way to a receiving unit in order to coordinate travelling of different separation elements.

In a preferred arrangement, control signals transmitted in a wireless or wired way from an input unit, that is manually or automatically actuated, can be processed in the control unit and the switch, the variable resistor, the optical output unit, the acoustic output unit and/or the electric lock can be controlled corresponding to the control signals, the position data and/or the movement data. The input unit can for example be a distance warning device which indicates the distance from a stop or an adjacent separation element.

The solution according to the invention thus allows the development of the displaceable separation elements to form autonomous and intelligent units. The separation elements can further be provided with drive units. Electric motors can be used for example which drive the rollers of the carriages or engage in a cogged belt by means of a shaft and a cogwheel.

Figure 1:
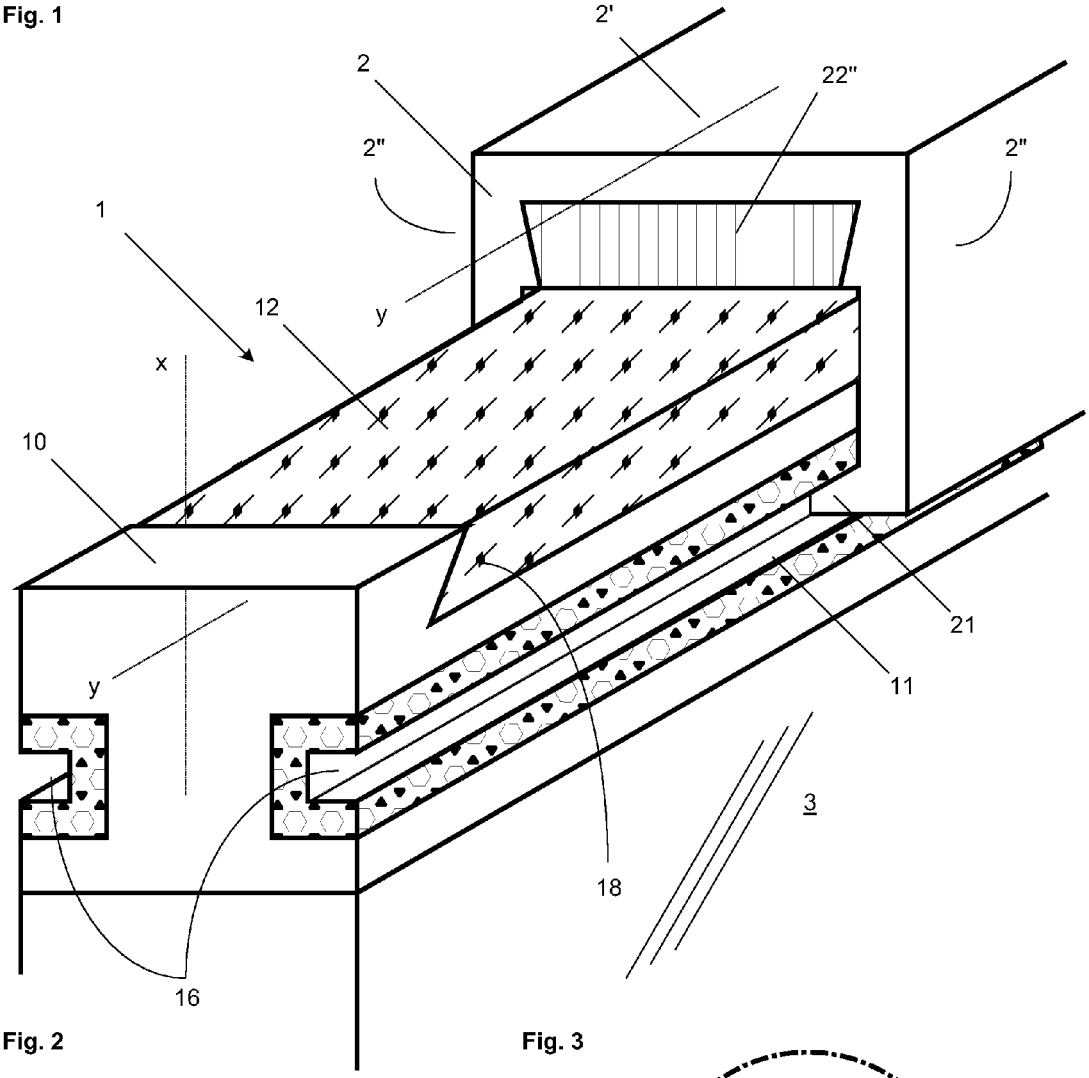
Figure 2:
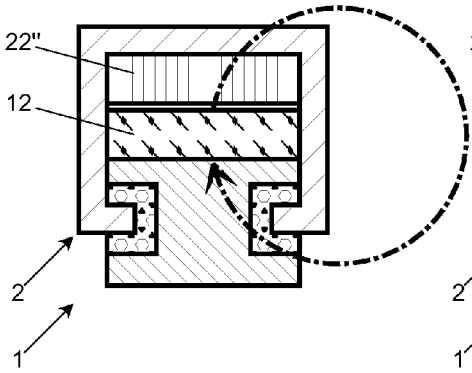
Figure 3:
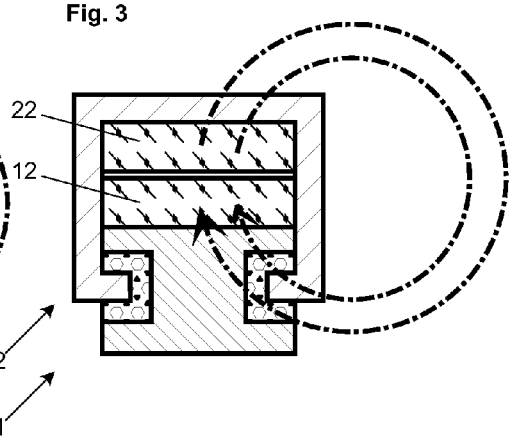
Figure 4:
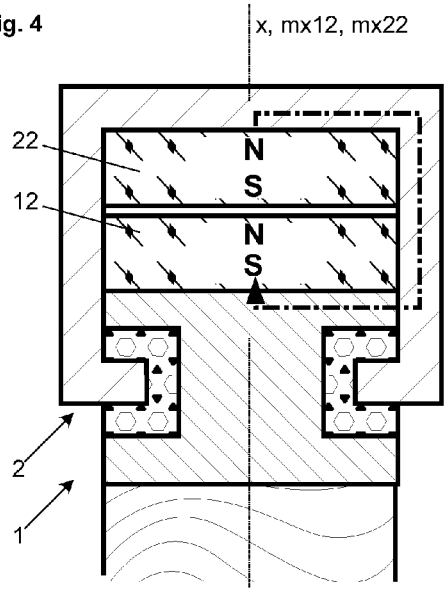
Figure 5:
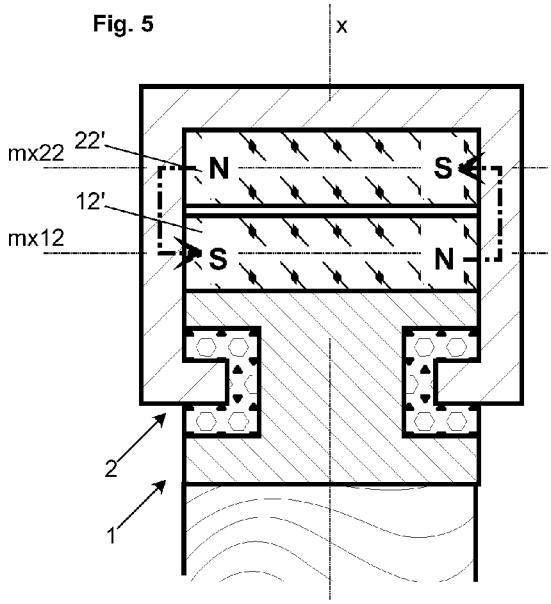
Figure 6:
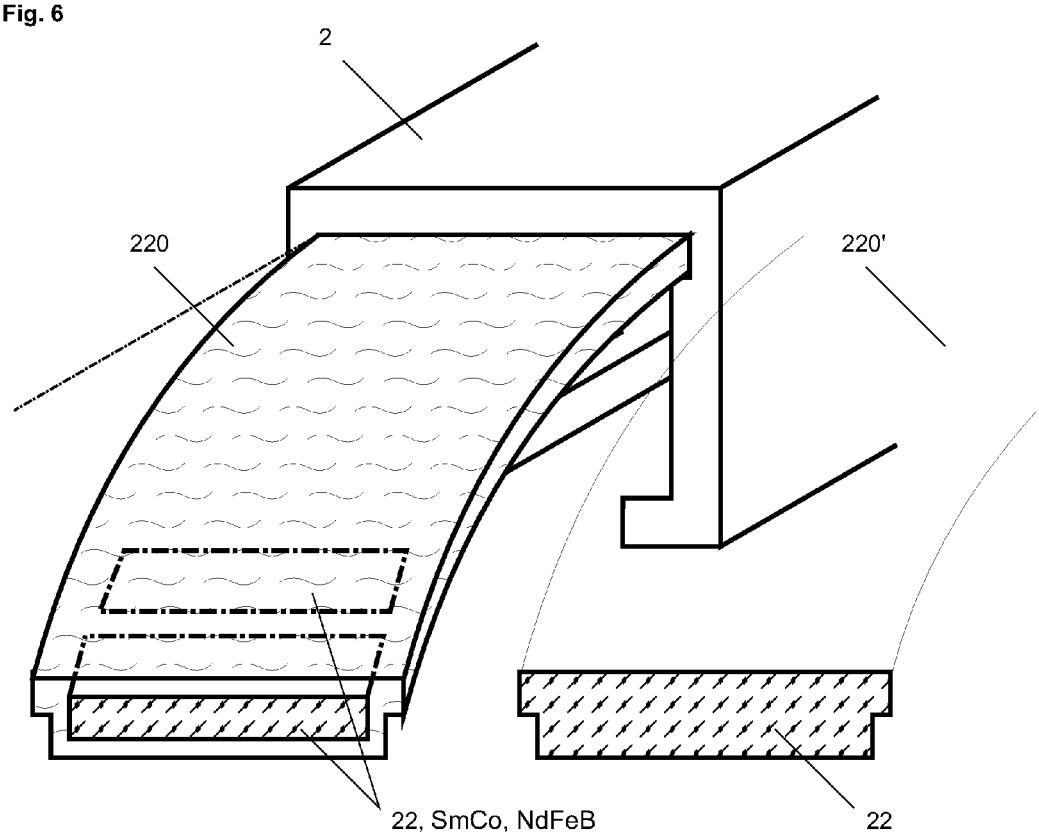
Figures 7, 7A:
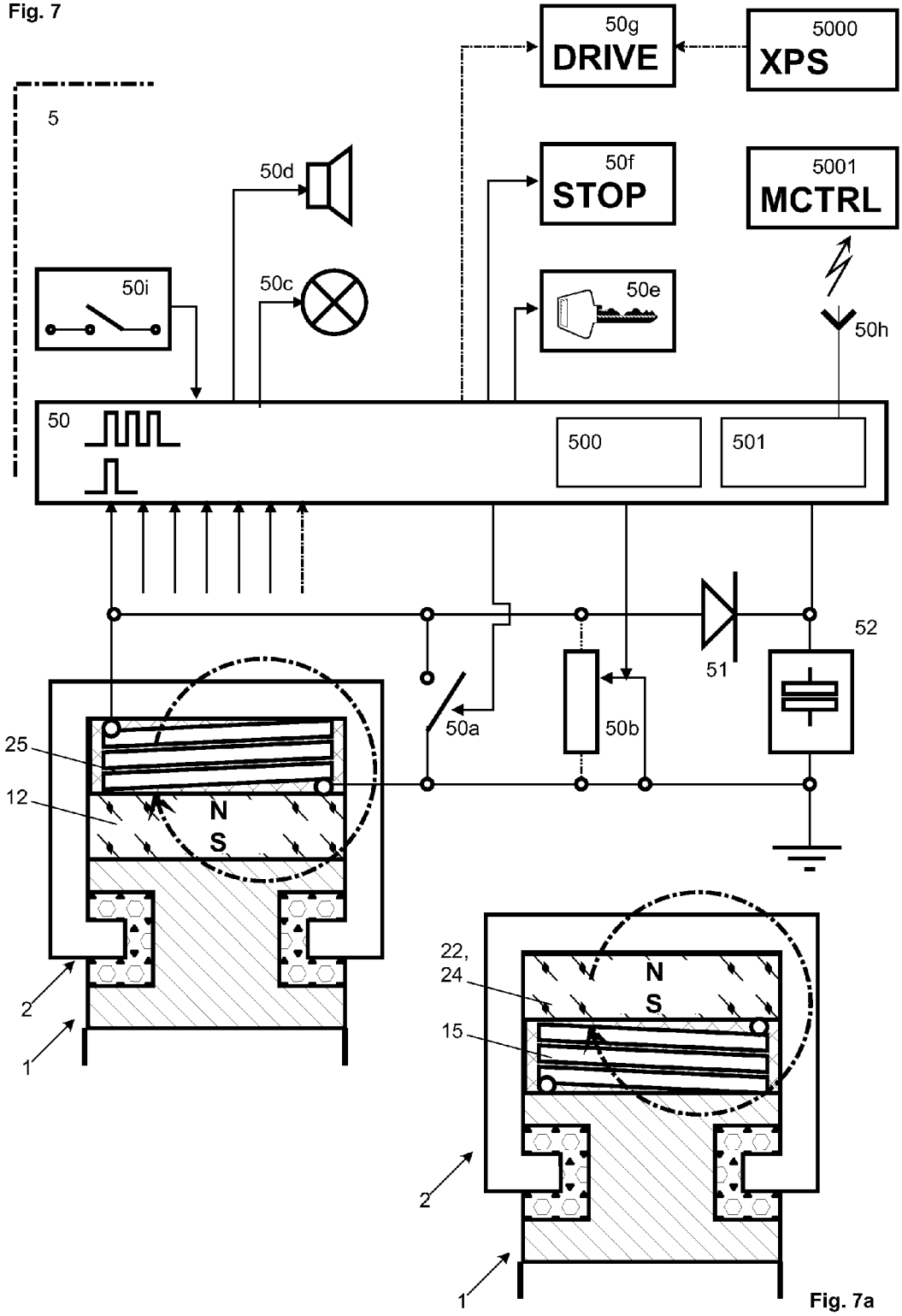

The invention is explained in greater detail below by reference to drawings, in which:

FIG. 1 shows a rail 2 provided with a ferromagnetic, possibly soft magnetic rail magnet 22", with a partially pulled out carriage 1 which carries a hard-magnetic carriage magnet 12 and is connected to a separation element 3;

FIG. 2 shows the carriage 1 and the rail 2 of FIG. 1 in a sectional view;

FIG. 3 shows the carriage 1 and the rail 2 of FIG. 2 provided with a hard-magnetic rail magnet 22;

FIG. 4 shows the carriage 1 and the rail 2 of FIG. 3 with magnetic elements 12, 22, of which the magnetic axes mx are vertically orientated;

FIG. 5 the carriage 1 and the rail 2 of FIG. 3 with magnetic elements 12', 22', of which the magnetic axes mx are horizontally orientated parallel to one another;

FIG. 6 plastic-bonded rail magnets 22; 220 either with incorporated high-energy magnet segments (220) or with conventional ferromagnetic materials;

FIG. 7 the carriage 1 and the rail 2 of FIG. 4 or FIG. 5 provided with a coil 25, with a power supply part 51, 52 and a control unit 50 and various control units 50*a*, . . . 50*g;*

Figure 10:
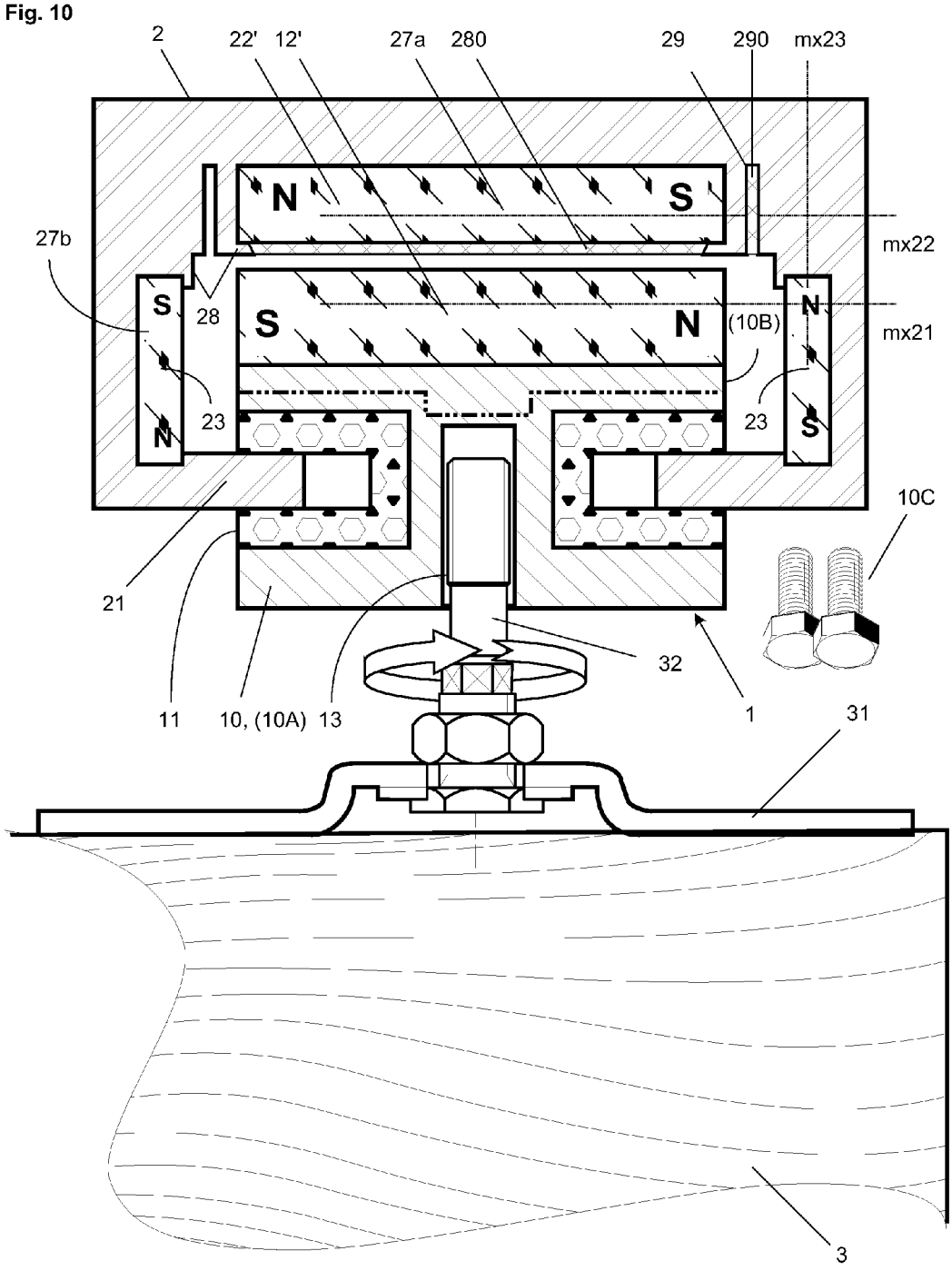
Figure 11:
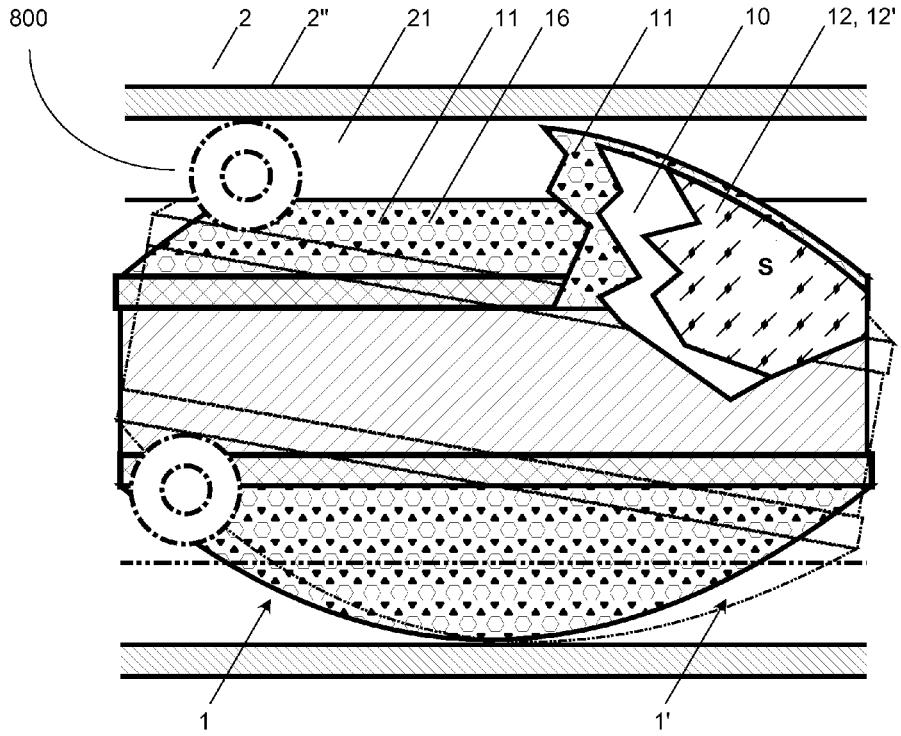
Figure 12:
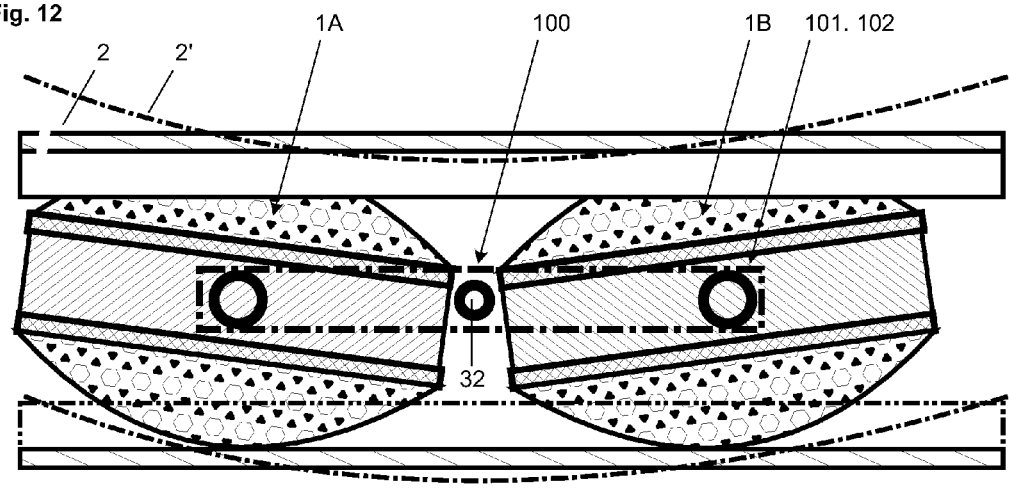
Figures 13, 14, 15, 16:
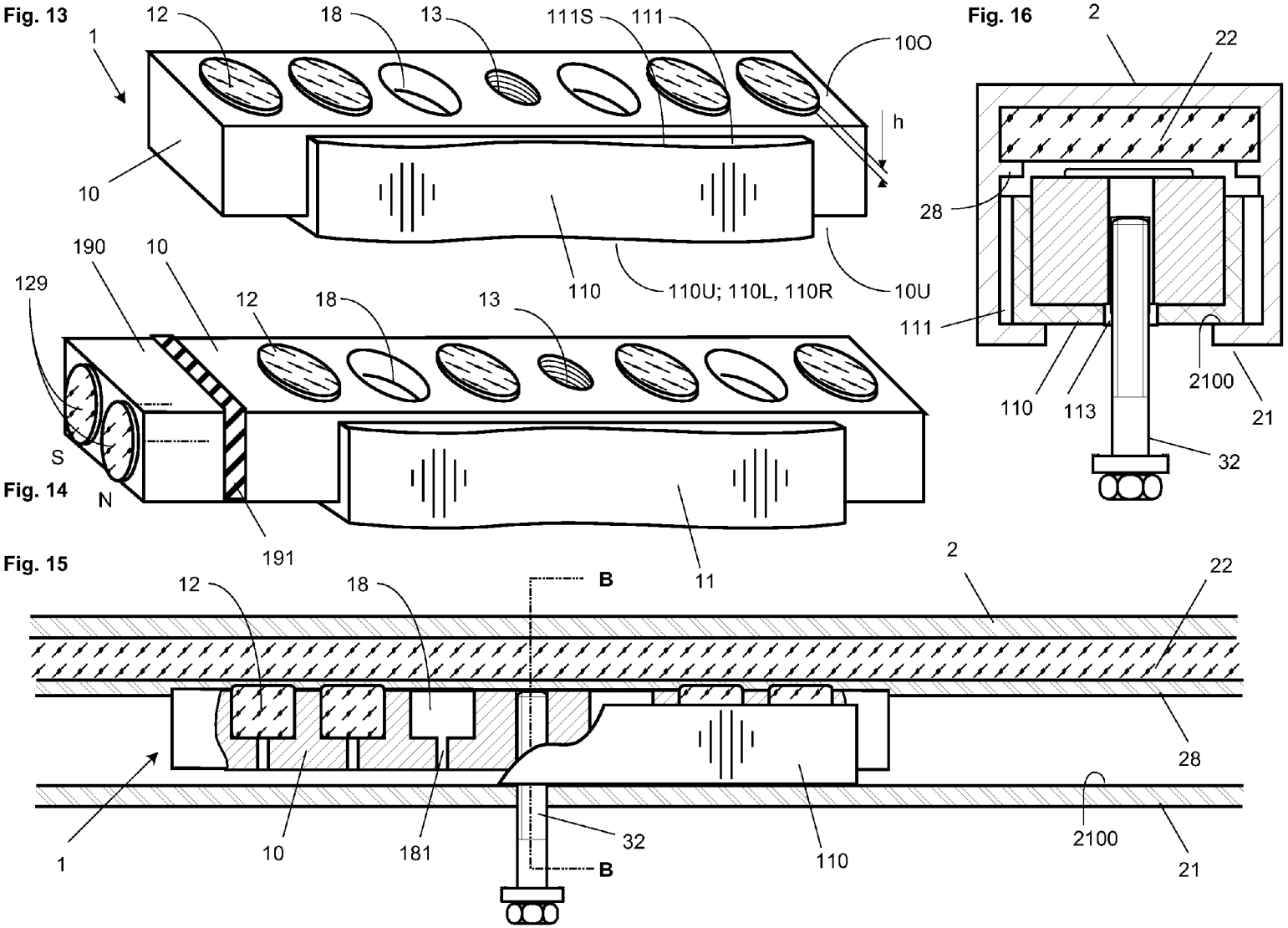
Figures 20, 21, 22, 23:
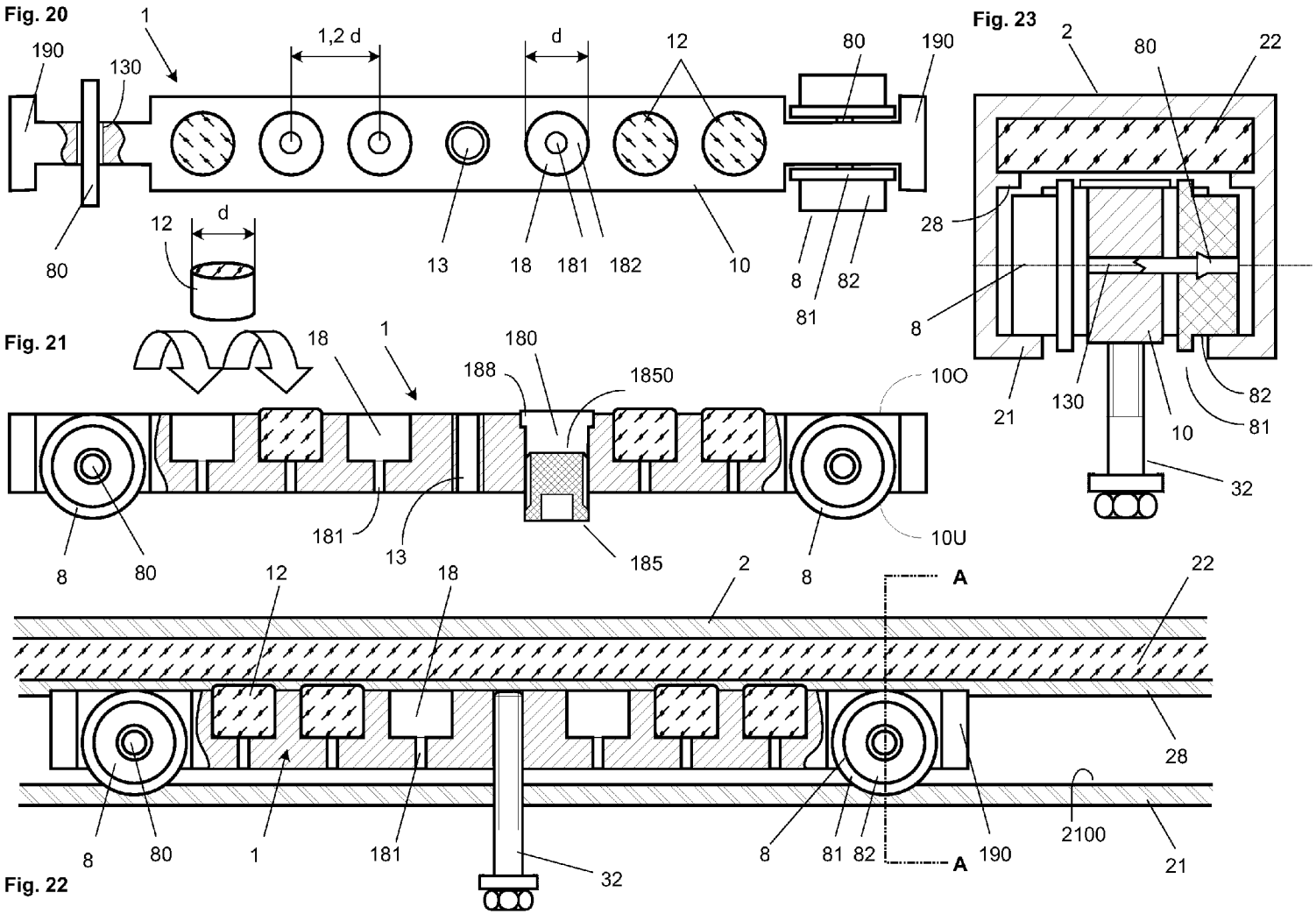
Figure 24:
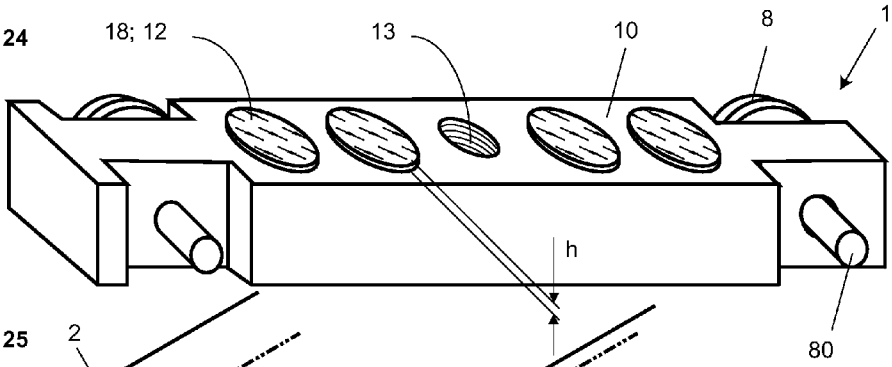
Figure 25:
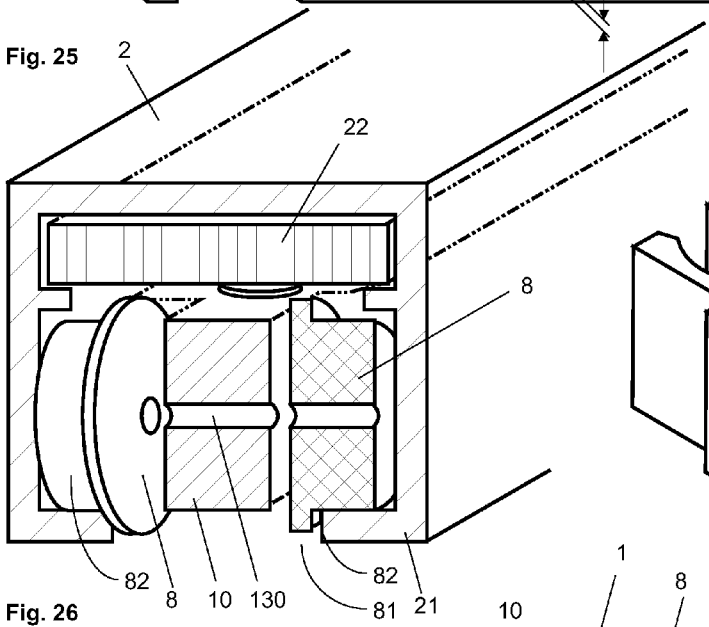
Figure 27:
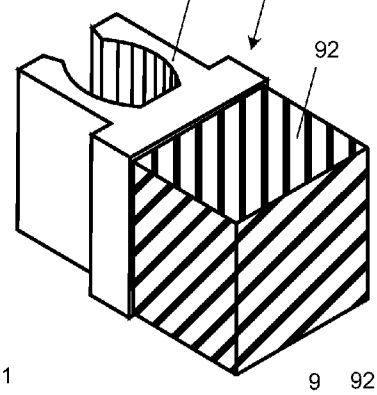
Figure 26:
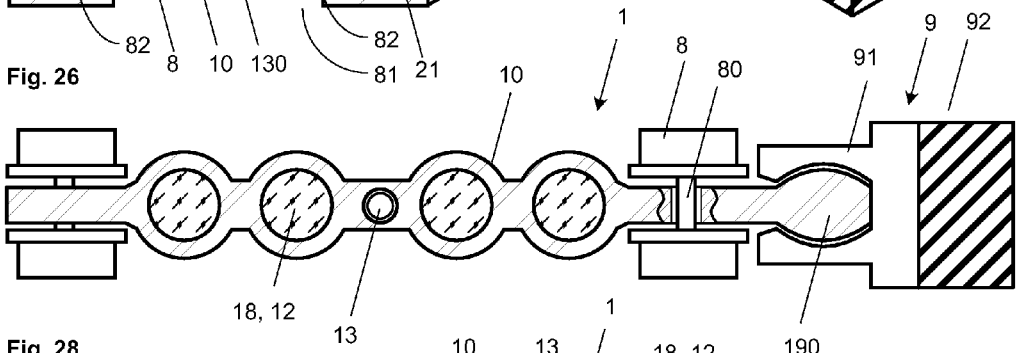
Figure 28:
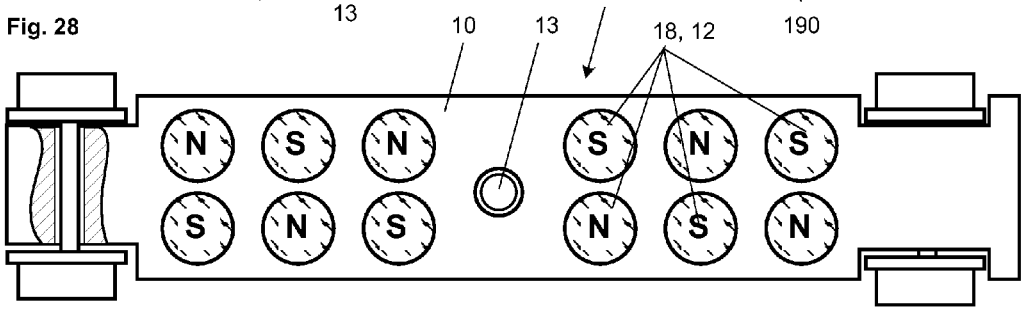
Figure 29:
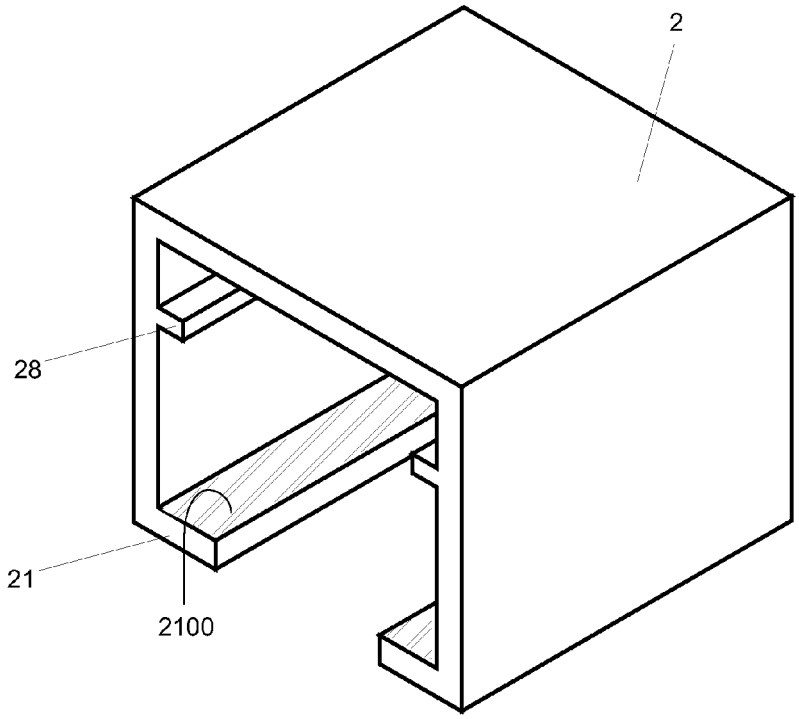
Figure 30:
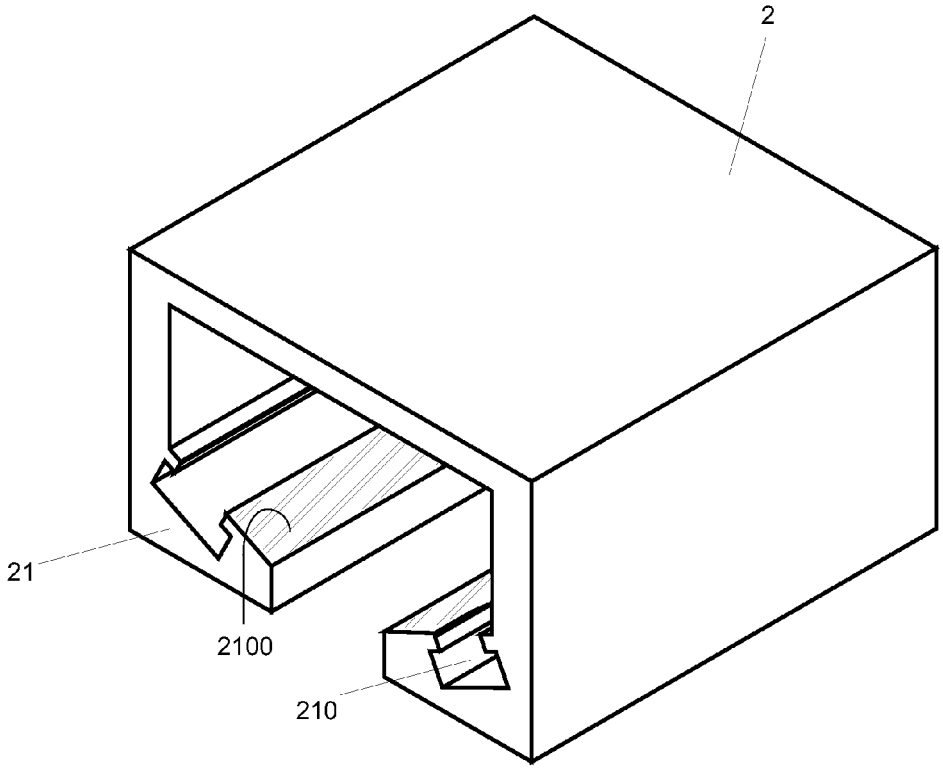
Figures 31, 31A:
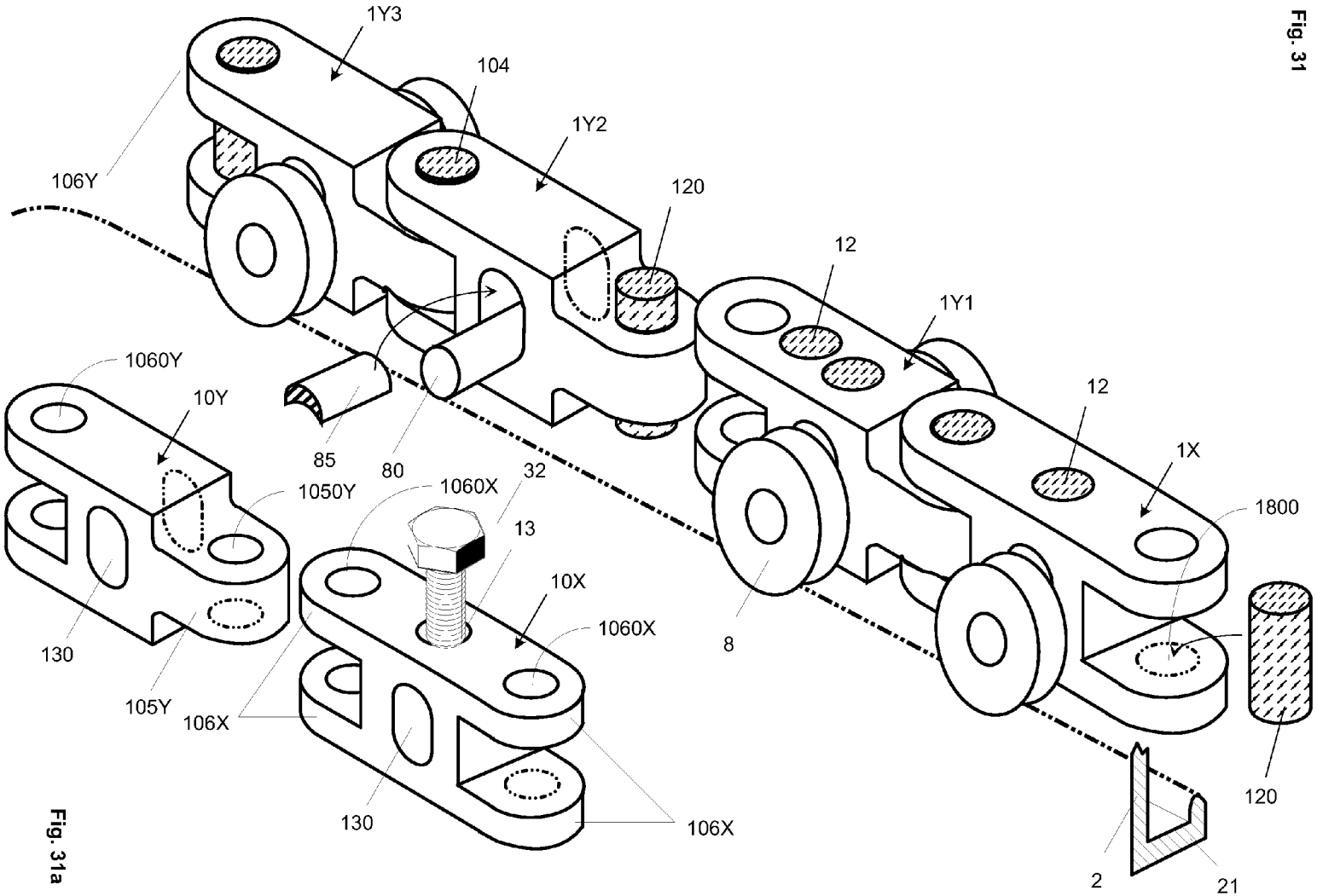
Figure 32:
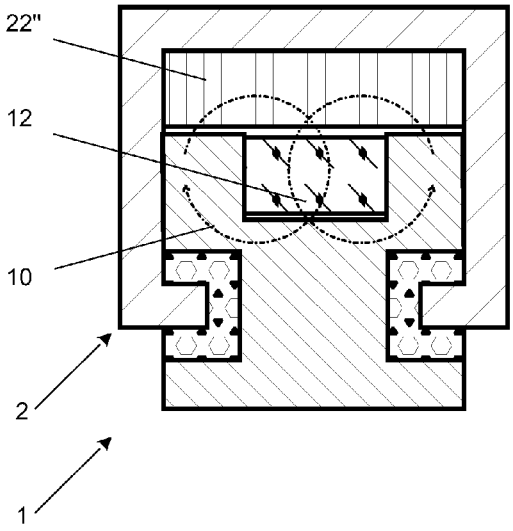
Figure 33:
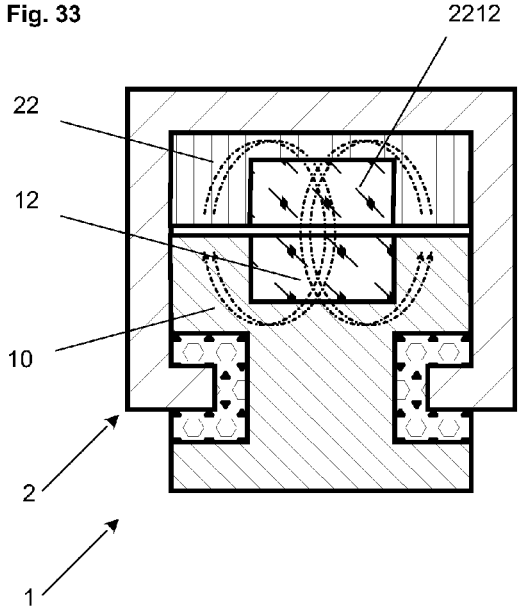

FIG. 7*a* the carriage 1 provided with a coil 15 which can also be connected to a circuit arrangement, as shown in FIG. 7;

FIG. 8 the carriage 1 of FIG. 4 connected by means of a flange 19 to a separation element 3 and provided with at least two carriage magnets;

FIG. 9 the carriage 1 of FIG. 5 with at least two carriage magnets 12' and an induction magnet 14, by means of which a current can be induced in the coil shown in FIG. 7;

FIG. 10 the carriage 1 of FIG. 9 connected by means of a connecting screw 32 to a separation element 3, said carriage 1 being supported so as to be displaceable on the rail 2;

FIG. 11 a carriage 1 which can be rotated in the rail 2 which is suitable for operation in bent rails 2;

FIG. 12 two carriages 1 which are coupled to one another and which can be rotated in the rail 2;

FIG. 13 a carriage 1 according to the invention with a cuboid-shaped carriage body 10 inserted into a U-profile-shaped sliding element 110, said carriage body 10 comprising a threaded bore 13 and six recesses 18, of which four are equipped with carriage magnets 12;

FIG. 14 the carriage 1 of FIG. 13 with an end element 190 supported elastically by means of an intermediate buffer 191 serving for buffering and parking, into which end element 190 two buffer magnets 129 are inserted;

FIG. 15 the carriage 1 of FIG. 13 inserted into a rail 2;

FIG. 16 the carriage 1 and the rail 2 of FIG. 15 in a sectional view along the section B-B;

FIG. 17 a carriage 1 with a carriage body 10 inserted into a U-profile-shaped sliding element 110, which is equipped on the lower side 10U in the edge regions 10L, 10R with a respective row of carriage magnets 12L, 12R which are repelled by rail magnets 2200L-R, 2200L'-R' which are provided in an opening 210 in the feet 21 of the rail 2;

FIG. 18 the carriage 1 of FIG. 17 seen from above;

FIG. 19 the carriage 1 of FIG. 17 seen from below;

FIG. 20 a carriage 1 according to the invention with a cuboid-shaped carriage body 10 which comprises a threaded bore 13 and six recesses 18, of which four are equipped with carriage magnets 12 and on the ends of which shafts 80 are provided with rollers 8;

FIG. 21 the carriage 1 of FIG. 20 with a side section through the threaded bore 13 and the six recesses 18;

FIG. 22 the carriage 1 of FIG. 20 inserted into a rail 2;

FIG. 23 the carriage 1 and the rail 2 of FIG. 22 provided with a hard-magnetic rail magnet 22 in sectional view along the section A-A;

FIG. 24 in a spatial representation, the carriage 1 of FIG. 20 with only four recesses 18;

FIG. 25 in a spatial representation, the carriage 1 and the rail 2 of FIG. 22 provided with a ferromagnetic rail magnet 22, in a sectional representation along the section A-A;

FIG. 26 a carriage 1 according to the invention with a preferably formed carriage body 10, of which the end element 190 is supported by a buffer 9;

FIG. 27 the buffer 9 of FIG. 26 in a spatial representation;

FIG. 28 a carriage 1 according to the invention with a carriage body 10 which is equipped with two rows of carriage magnets 12 with alternating polarity;

FIG. 29 a segment of the rail 2 of FIG. 16 or FIG. 23 in a spatial representation;

FIG. 30 a segment of the rail 2 of FIG. 17 in a spatial representation;

FIG. 31 a carriage 1X according to the invention which comprises only one shaft 80, preferably supported by means of an elastic element 85, with two wheels 8, of which the carriage body 10X is connected on both sides by means of flange elements 106X and a preferably magnetic hinged bolt 120 to a respective single-axis carriage element 1Y) in such a way that the carriage 1X which can be connected by means of a connecting screw 32 to the separation element 3 and the carriage elements 1Y are only rotatable against one another in one plane;

FIG. 31*a* the carriage 1X provided with a suspension screw 32, seen from below;

FIG. 32 the carriage of FIG. 1, in the carriage body 10 of which, as shown in FIG. 13, cylindrical carriage magnets 12 are embedded;

FIG. 33 the carriage of FIG. 32 and a ferromagnetic rail magnet 22, in which hard-magnetic, cylindrical carriage magnets 2212 are embedded; and FIG. 34 the known carriage 100 which was initially discussed.

In FIGS. 1 to 19 solutions are described, wherein the body 10 of the carriage 1 is mechanically supported on the feet 21 of the rail 2 by means of sliding elements 11, 110. In FIGS. 20 to 28 solutions are described, wherein the carriage body 1 is mechanically supported on the feet 21 of the rail 2 by means of shafts 80 and rollers or wheels 8. The described use of the carriage and rail magnets 12, 120 and 22. 22', 22', 220, 220', 2200 can, subject to the design of FIG. 17, be exchanged for the two types of solution; i.e. the carriage body 10 of the described carriages can be provided, as desired, with rolling or sliding materials. Plain bearings or ball bearings can be provided to support the rollers 8. With regard to the required smooth running of the carriages 1, rollers with plain bearings are preferred.

FIG. 1 shows a carriage 2 provided with a ferromagnetic, for example soft magnetic rail magnet 22", with a central part 2' and two lateral parts 2", into which a carriage 1 provided with a carriage body 10 is introduced which is connected to a separation element 3.

The rails 2 are preferably manufactured from aluminium with a good surface quality [e.g. N6 (0.8-1.0 μm] and for example refined with an anodised layer in the range of 10 to 12 μm. Possibilities for mounting the rail 2 are described for example in [4], EP 1 197 624 A1.

The carriage body 10 is provided on its sides with grooves 16 extending parallel to one another, into which U-profile-shaped sliding elements are fitted. The lateral parts 2" of the rail 2 are provided on the lower ends with opposing rail feet 21 which serve as sliding ribs and engage at least partially into the carriage body 10 or into the associated sliding element 11. The rail feet 21 are provided, on the lower side and the upper side, preferably also on the front side, with sliding surfaces, in such a way that they are supported so as to slide in a practically friction-free way on all inner sides of the preferably self-lubricating sliding elements 11. The sliding elements 11 are preferably provided with a solid or dry lubricant which ensures lifelong lubrication of the plain bearing. Self-lubricating sliding elements provided with a solid or dry lubricant are preferably used. Sliding elements 11 are therefore preferably used with a high mechanical strength, rigidity and hardness, with a low and constant coefficient of sliding friction, with a very high wear resistance and a very high dimensional stability. Hard plastics such as Teflon are suitable or technical plastics which can be obtained in commerce such as ERTALON®PA, NYLATRON®, ERTACETAL®POM, ERTALYTE®PET or ERTALYTE®TX provided with solid lubricant or substances with comparable properties. It is particularly advantageous to use slide-modified POM types such as Hostaform which cooperates optimally with anodised rails 2 and is also best suited for the production of the rollers or wheels of the carriages 1 of FIGS. 20 to 28.

The preferably ferromagnetic carriage body 10 further comprises on its upper side a recess 18, into which a hard-magnetic carriage magnet 12 is fitted, of which the field lines run through the rail magnet 22" which is connected below the central part 2' of the rail 2 to it.

The carriage magnet 12 and the rail magnet 22" are preferably connected in a shape-locking way to the carriage body 10 or the rail 2 (see FIG. 1) or bonded, screwed of wedged thereto or connected to one another in a different way. Insofar as the carriage magnet 12 is extensively enclosed in the recess 18 by the ferromagnetic carriage body 10, it is held securely in the recess 18 without further aids and can, in the arrangement of FIG. 13 or FIG. 20, practically only be released in that a through channel 181 is provided, through which a tool can be introduced from the opposite side into the recess 18 which is cylindrical for example.

Plastic-bonded magnets 220, 220', as shown in FIG. 6, can be particularly advantageously fitted into the carriage body 10 or into the rail 2, for example into a rail 2 which is bent for travel around curves. Such a plastic strip provided with incorporated magnets or ferromagnetic materials can be machined through conventional milling, in particular be shortened.

FIG. 2 shows the carriage 1 and the rail 2 of FIG. 1 in a sectional representation. FIG. 3 shows the carriage 1 and the rail 2 of FIG. 2 provided with a hard-magnetic rail magnet 22. It is schematically shown in FIG. 2 and FIG. 3 that by using two hard-magnetic elements 12, 22 a higher magnetic flux and thus a greater interaction and a greater magnetic force result, by means of which the two hard-magnetic elements 12, 22 or the carriage 1 and the rail 2 are pulled against one another. Insofar as the rail magnet 22 is not a hard magnet, it is essential that it should have high permeability (Ll,>>1), whereby this is the case with known ferromagnetic materials but not with paramagnetic materials.

The magnetic axes mx12, mx22 of the two hard-magnetic elements 12, 22 are orientated parallel to the gravity axis x of the carrier element in the device of FIG. 4 and perpendicularly thereto in the device of FIG. 5, whereby in FIG. 4 a pair of unlike poles lie opposite and in FIG. 5 two pairs of unlike poles lie opposite one another. The advantages of these arrangements have been described above.

As mentioned above, the loading of the mechanical bearings used can be reduced to a minimum with the choice of high-quality magnetic elements and corresponding materials. In recent years increasingly efficient materials have been found and alloys developed such as ferrite, AlNiCo, SmCo, NdFeB. Plastic-bonded magnets have also been developed.

Hard ferrite magnets are the materials used most frequently worldwide. Barium ferrite and strontium ferrite are sintered substances of the metal oxides BaO2 and SrO2 in association with Fe203. These raw materials are available in large quantities and are favourable. The magnets are produced isotropically and anisotropically. Isotropic magnets have around the same magnetic values in all directions and can thus be magnetised in all axial directions. They have a low energy density and are comparatively favourable. Anisotropic magnets are produced in a magnetic field and thereby obtain a preferential direction of magnetisation. In comparison with isotropic magnets, the energy density is around 300% higher. The coercive field strength is high in relation to the remanence.

AlNiCo magnets which are normally produced anisotropically are metal alloy magnets of aluminium, nickel, cobalt and iron, copper and titanium. They are produced through sand casting, chill casting, vacuum casting and sintering. AlNiCo magnets have a low coercive field strength with a high remanence, meaning that they must have a great length in the direction of magnetisation in order to have good resistance to demagnetisation.

Permanent magnets from the rare earths are described as high-energy magnets. These materials are characterised by their high energy product of over 300 kJ per cubic metre. Materials of the lanthanide group, particularly samarium cobalt (SmCO) and neodymium-iron-boron (NdFeB), are thereby of practical significance. A barium ferrite magnet with the same effect (e.g. 100 mT induction at 1 mm distance from the pole area) must be 25 times larger than a samarium-cobalt magnet. The energy product of NdFeB is even around 50% higher. The production of SmCo and NdFeB magnets takes place by melting the alloy. The material blocks are then broken and ground to form a fine powder, pressed in the magnetic field and then sintered. The moulded magnets are cut from the rough blocks with a diamond saw under water. For large numbers the powder is pressed in moulds and subsequently sintered. After moulding, magnetisation takes place until saturation. For this, high magnetic field strengths are required. In order to generate these high field strengths, charged condenser batteries are pulse-discharged in an air coil. The magnetic body lying in the inner hole of the low-ohm air coil is magnetised until saturation through the pulse discharge. In principle magnetisation is only possible in the preferential direction characterised during production. SmCo magnets are very hard and brittle, NdFeB magnets and hard and less brittle. Strong magnetic fields do not cause any weakening of the magnetic fields either. Neither of the materials is resistant to anorganic acids and alkalis. Constant contact with water also leads to corrosion (with NdFeB, a high air humidity already causes surface oxidation) (from "Permanentmagnet-Grundlagen" ["Principles of Permanent Magnets"], Institute for Electrical Energy Technology, Faculty of Electrical Engineering, TU Berlin [Technical University of Berlin], Jan. 7, 1998 (see http://www.iee.tu-burlin.de/forschung/permmag/grundlagen.html. The hard magnets used are therefore preferably sealed or coated with metals. Preferably, the recesses 18 have a sealed finished, for example by means of a varnish.

Furthermore, plastic-bonded magnets can be obtained today. For their production magnetic substances are pulverised, mixed with suitable plastics and worked on through calendering, extrusion, pressing or injection moulding to form finished magnets. As shown in FIG. 6, high-energy magnetic segments can also be bonded into a plastic in order to realise an elastic and nonetheless efficient elongated magnet.

The use of magnetic elements to remove the load from the mechanical elements has further advantages. By means of coils 15, 25 (see FIGS. 7 and 7*a*) which are fixed on the carriage 1 or within the rail 2, field changes can be detected in the case of relative movements between the carriage 1 and the rail 2 and converted into electric currents which are suitable on the other hand for determining the position or kinematic data of the carriage 1 or the separation element 3 and on the other hand for charging an accumulator 52. Through the short circuiting or low-ohm termination of the coils 15, 25 by means of a switch 50*a* or by means of a controllable resistor 50*b*, magnetic fields can be generated in the coil 15, 25 which work against the fields of the magnets passing by in such a way that the course of the separation element 3 can be optionally braked or damped. As shown in FIGS. 7*a* and 9, separate, preferably fourth magnetic elements 14, 24 are used for the interaction with the coil 15 or 25, the polarity of said magnetic elements 14, 24 being perpendicular to the polarities of the further magnetic elements. This allows the precise localisation of the carriage 1 within the rail 2. A plurality of coils 25 or magnets 24 are preferably provided along the path of the carriage 1, by means of which further position data and kinematic data, data relating to the speed and the acceleration can be determined for the separation element 3. With the aid of these data and existing instructions, possible control data permanently stored in a memory 500 or input via an input unit 50*i*, different control functions can be advantageously realised. For example, in the case of high speeds, particularly in the region of an end position, the switch 50*a* or the controllable resistor 50*b* or an electromechanical braking device 50*f* can be actuated. The input unit 50*i* may also be suitable for measuring the distance from obstacles or an end stop in such a way that corresponding braking manoeuvres can be introduced. Furthermore, a display unit 50*c* and a loud speaker 50*d* may be provided, by means of which the behaviour of the separation element 3 can be indicated. For example, during travel, a red flashing signal is shown, during standstill a green signal and in the locked state a blue signal. Insofar as corresponding instructions exist, the separation element 3 can be locked in the end position automatically by means of an electric lock 50*e*. In order to realise these functions the control device 5 shown in FIG. 7 comprises a control unit 50 which is connected to one or more coils 15, 25 and connected to the accumulator 52 which is connected by means of a diode 51 to one or more coils 15, 25.

By means of the control unit 50 an electric drive 50*g* can also be actuated which is supplied by an external power source 5000. Corresponding drive and control devices which are arranged within the separation element 3 or connected to the carriage 1 within the rail 2 are described for example in WO 2004/005656 A1.

The device parts 50*a*, . . . , 50*i* shown in FIG. 7 can therefore be realised either individually or as a whole in the rail 2 or in the separation element 3, for example within the profiled parts thereof. For the control of a system with a plurality of separation elements 3 the local control units 50 are connected in a wireless or wired way to a central control unit 5001.

As described above, the present invention can be used with straight or bent rails 2 for travel around curves. In order to realise travel in a bent rail 2 a carriage 1 is provided with sliding elements 11 which is supported by the rail 2 or the sliding ribs 21 so as to be rotatable and/or displaceable in a plane. As shown in FIG. 10, laterally mounted hard-magnetic guide magnets 23 are provided for centred guiding of the carriage 1 which is supported so as to be rotatable and/or displaceable, of which hard-magnetic guide magnets 23 at least one pole cooperates with a pole of the same orientation of the carriage magnets 12, 12', in such a way that the latter are pushed with the carriage 1 from both sides into a central position. This can take place in a particularly space-saving way with guide magnets, of which the magnetic axes mx23 lie perpendicular to the magnetic axes mx12 of the carriage magnets 12'. It is thereby advantageous for the magnetic poles of the rail magnets 22' and the guide magnets 23 to be uncoupled from one another. For this, on both sides of the rail magnets 22', deep slots 29 are incorporated into the central part 2' of the rail 2 which are preferably filled with a magnetically non-conductive or scarcely conductive, preferably diamagnetic material 290.

It is further shown in FIG. 10 that the sliding ribs 21 only partially enter the sliding elements 11 in such a way that the carriage 1 can be displaced between the lateral parts 11, but is constantly repelled back into a central position by the guide magnets 23.

The rail 2 is provided with recesses 27*a*, 27*b* to receive the rail magnets 22' and the guide magnets 23, into which recesses 27*a*, 27*b* said magnets can be inserted or pushed. For holding the possibly plastic-bonded magnets 22', 23, retaining elements 28 and/or preferably magnetically non-conductive or diamagnetic locking elements 280 are provided, by means of which the recesses 27*a*, 27*b* can be locked.

FIG. 10 shows the carriage body 10 schematically with two parts 10A, 10B, the mutual distance being set by means of screws 10C, whereby at the same time a suitable air gap results between the first and second magnetic elements 12, 12' and 22, 22', 22". This takes place with simpler measures with the carriage 1 of FIG. 21.

The effective magnetic forces can therefore be adapted to the existing load conditions or the weight of the separation element by changing the air gap. Additionally or alternatively, the corresponding use of other magnetic materials or an adapted number of magnetic elements or a volume adaptation of the magnetic elements can also be provided.

FIG. 10 also shows a further device, by means of which the carriage body 10 can be connected to the separation element 3. An adjustable connecting screw 32 which holds the separation element 3 by means of a fixing device 31 is thereby screwed into a threaded bore 13 provided in the carriage body 10. In the device of FIG. 8 the carriage body 10 on the other hand comprises a flange 19 which is connected to the separation element 3.

FIG. 11 shows, in two positions, a carriage 1 supported in the rail 2 so as to be rotatable which comprises parabolically extending outer sides, over which the sliding elements 11 preferably project in such a way that they form a plain bearing with the inner sides of the lateral parts 2" of the rail 2 insofar as they come into contact. These carriages 1 are, as described above, equipped with magnetic elements but can also be used without them.

FIG. 12 shows two carriages 1A and 1B supported in the rail 2 so as to be rotatable, said carriages 1A and 1B being coupled to one another with the aid of a coupling device 100 and connecting or bearing devices 101, 102 provided on both sides thereof. The coupling device 100 is for example a metal profile with a threaded bore, into which the connecting screw 32 can be introduced.

FIG. 13 shows a carriage 1 according to the invention with a cuboid-shaped carriage body 10 which comprises a threaded bore 13 and six recesses 18, of which each two are equipped on both sides of the threaded bore 13 with carriage magnets 12. The carriage magnets 12 and the recesses 18 are dimensioned in such a way that the outer pole of the carriage magnet 12 projects over the carriage body and lies freely in such a way that on the one hand no direct flux return of the two poles can take place via the carriage body 10 and at the same time the control of the distance from the carriage magnet 22, . . . is simplified. For the controlled reduction of the flux return between the carriage magnet 12 and the carriage body 10 which pulls the carriage magnet 12 into the recess 18, furthermore, as shown in FIG. 21, an annular recess 185 can be provided at the outer end of the recess 18, through which the pole in question is isolated in relation to the carriage body. As mentioned at the beginning, the use of cup-shaped or cylindrical hard-magnetic round magnets is particularly advantageous as these have good magnetic properties and can be mechanically mounted in a simple way. The carriage magnets 12 can all be inserted with the same pole orientation into the carriage body 10. For a possibly preferred formation of the magnetic field, the carriage magnets 12 can, however, also be inserted with a pole orientation changing by preferably 90° or 180° in such a way that for example a Halbach magnet array or a similarly working magnetic system results. By means of this technology, for example, fields with stronger orientation and reduced pole characterisation and thus a smoother course of the carriage 1 can be achieved.

Possible orientations of the magnets are shown and described for example at http://www.powerditto.de/magnet-system.html and at http://www.wondermagnet.com/halbach.html. FIG. 28 shows for example a carriage 1 according to the invention with a carriage body 10 which is equipped with two rows of carriage magnets 12 with alternating polarity. The positioning of the recesses 18 and the orientation of the magnetic axes of the carriage magnets 12 is thereby preferably individually determined, whereby in particular rectangular, triangular, saw-tooth-line and honeycomb-shaped arrangements of the recesses 18 have proved themselves well. Likewise, the appropriate number of recesses 18 and the number of elements of the carriage magnets 12 are selected. Said arrangements or positioning of the recesses 18 can naturally also be chosen with uniform orientation of the magnetic axes.

The formation of the carriage body 10 shown in FIG. 13, whether using sliding material (see FIG. 13) or using rolling material (see FIG. 20), has numerous advantages. The ferromagnetic carriage body 10, for example manufactured from iron, which can be easily produced with small dimensions serves as a flux return body, in which the carriage magnets 12 can be assembled and embedded in a stable way through simple insertion. The recesses 18 are thereby formed in such a way that their inner area lies close to the carriage magnet 12 and holds this stable at least laterally. Insofar as the inner area of the recess 18 also lies laterally against the carriage magnet 12, a freely selectable flux return of the magnetic field lines results, through which the carriage magnet 12 is held in the recess.

The carriage magnets 12 can be inserted with simple measures into the carriage body 10 and surface-refined, for example polished, in order to achieve low surface roughness. With minimal manufacturing and assembly resources, therefore, a carriage body 10 can be produced which can be optimally inserted into the magnetic system. On account of the small dimensions of the carriage body 10 the resulting carriage 1 can be inserted into rails 2 with minimal diameter, whereby this is particularly advantageous in case of use in the field of furniture. On account of the magnetic support, even with small dimensions, however, high loads can still be mounted. Furthermore, the carriage body can optionally be equipped with a number of carriage magnets 12 chosen to correspond to the load in such a way that a broad field of application results for a carriage 1. Insofar as a greater number of carriage magnets 12 are needed, a longer carriage body 10 is selected with a correspondingly higher number of recesses 18. All in all, an exceptionally advantageous modularity results for the user who is familiar with the installation of these systems, said modularity making minimum demands upon the support arrangement.

In FIG. 13 the carriage body 10 is inserted in a clearance-free way into a U-profile-shaped sliding element 110, of which the planar lower side 110U can slide in the edge regions 110L, 110R on the running surfaces 2100 of the rail feet 21, as shown in FIGS. 15 and 16 (see also FIGS. 18 and 19). The sliding element 110 which is preferably manufactured from Hostaform further comprises an opening 113, through which a connecting screw 32 can be introduced into the threaded bore 13 provided in the carriage body 10 in order to assemble the separation element 3 (see FIG. 10). The lateral walls 110S of the sliding element 110 comprise two wave-like bulging areas 111 which are guided on the inner sides of the lateral elements, 2', 2" of the rail 2 and which only cause a low frictional resistance upon contact with the rail 2.

FIG. 14 shows the carriage 1 of FIG. 13 with an end element 190 supported elastically by means of an intermediate buffer 191 and serving for buffering and parking, into which end element 190 two buffer magnets 129 are inserted in the manner described for the carriage magnets 12. In the parked position the buffer magnets 129 which have different polarity contact a thin elastic edge element which covers a flux return plate which connects the different poles of the two buffer magnets 129 to one another and holds the carriage 1 securely. The buffer magnets 129 can be released again through a jerk or through displacement of the flux return plate. The intermediate buffer 191 serves on the other hand as a shock absorber during movement into the parking position.

FIG. 15 shows the carriage 1 of FIG. 13 inserted into a rail 2. FIG. 16 shows the carriage 1 and the rail 2 of FIG. 15 in a sectional representation along the section B-B.

FIG. 17 shows a carriage 1 with a carriage body 10 shown spatially from below and above in FIGS. 18 and 19 which is provided on the lower side 10U in the inclined edge regions 10L, 10R with a respective row of recesses 18L, 18R, into which carriage magnets 12L, 12R are inserted. The carriage body 1 is inserted in a clearance-free way into a U-profile-shaped sliding element 110 made for example of Hostaform, of which the lower side 110U can slide in the inclined edge regions 110L, 110R on the likewise inclined running surfaces 2100 of the rail feet 21, as shown in FIG. 17. Openings 118 are provided in the edge regions 110L, 110R of the sliding element 110, through which the carriage magnets 12L, 12R can possibly go and partially enter a receiving channel 210 in the rail foot 21.

In the receiving channel 210 of each rail foot 21, hard-magnetic rail magnets 2200L, 2200R or 2200L', 2200R' are inserted in such a way that like poles of the carriage magnets 12 and the rail magnets 2200 lie opposite one another, so that repulsive forces acting on the carriage 1 are produced, of which the resulting vector runs parallel but contrary to the load vector of the separation element 3 connected to the carriage 1. A central positioning of the carriage 1 which is at the same time orientated along the axis of the rail 2 results through the merely preferable inclination of the two edge regions 10L, 10R; 110L, 110R of the carriage body 10 and the sliding element 110 with simultaneous influencing of the load vector.

The rail magnets 2200, 2200 inserted into the T-profile-shaped receiving channel 210 of each rail foot 21 may have differing composition. On the one hand plastic-bonded strip magnets 2200L', 2200R' can be inserted. On the other hand round magnets 2212 can be inserted into ferromagnetic profiles 2210 which for their part are pushed into the receiving channel 210 and which, like the carriage bodies 10, serve as flux return bodies.

When using the solution according to the invention therefore very good results can be achieved with the carriages 1 shown in FIGS. 1 to 19. The rolling material shown in FIGS. 20 to 28 can also be advantageously used for supporting the carriages 1. The sliding and rolling technologies thereby have different property profiles, in such a way that the user or the manufacturer will prefer one technology or the other. It is interesting that the solution according to the invention can be advantageously used with both technologies in such a way that in each case extraordinarily efficient devices result for supporting displaceable separation elements which at the same time have reduced dimensions.

FIG. 20 shows a carriage 1 according to the invention with a cuboid-shaped carriage body 10 which comprises a threaded bore 13 and six recesses 18, of which four are equipped with carriage magnets 12 and on the ends of which shafts 80 are provided with rollers 8. The arrangement and assembly of the carriage magnets 12 in the carriage body 10 corresponds to that of FIG. 13. FIG. 20 additionally shows that the distance between the central points of two adjacent recesses 18 is larger by around factor 1.2 than the diameter of a recess 18 or a carriage magnet 12. An optimal effect of the inserted carriage magnets 12 is thereby achieved while extensively avoiding disruptive interactions. Said factor may of course also be selected so as to deviate from the indicated value and may for example be clearly higher than 1.2, insofar as the dimensions of the carriage 1 allow this.

It is further shown in FIGS. 20 and 21 that the bottom or the base 182 of the recess 18 which is preferably surface-treated (for example by grinding, honing, reaming) and or surface-refined (for example by the coating or the depositing of suitable materials) is connected to a through channel 181 which is open on both sides which allows liquid, moisture or air to escape from the recess 18, particularly when the carriage magnet 12 is inserted. Furthermore a tool can be introduced into the through channel 181 in order to remove an inserted carriage magnet 12 from the recess 18.

FIG. 21 further shows that the recess 18 may be completely bored through in a preferred embodiment and provided with a thread, into which a screw bolt 185 can be screwed in order to adjust the carriage magnet 12 lying thereon. It is also possible to use a hard-magnetic threaded bolt 185 which for its part forms the carriage magnet 12. It is further advantageous when using threaded bolts 185 that these can be produced by specialist manufacturers with desired surface tempering or refining.

It is further shown in FIG. 21 that the outer edge of the recess 18 can be provided with an annular bore 188 which separates the adjacent pole of the carriage magnet 12 from the carriage body. An interference-causing direct flux return from this pole to the carriage body 10 is thereby prevented, i.e. the flux return takes place practically completely via the carriage magnet 22; . . . .

The carriage body 10 is provided at each end with a shaft 80 which is securely held and on which the rollers 8 placed thereon slide, said rollers 8 being manufactured for example from Hostaform. It is shown in FIGS. 22 and 23 that the rollers comprise a first roller part 82 which rolls on the sliding surface 2100 of a rail foot 21 and a second roller part 81 which projects laterally over the rail foot 21 and guides the carriage 1.

The carriage body 1 further comprises terminating elements 190 which can be used for coupling or buffer purposes.

FIG. 24 shows, in a spatial representation, the carriage 1 of FIG. 20 whereby only four recesses 18 equipped with carriage magnets 12 are provided.

FIG. 25 shows, in a spatial representation, the carriage 1 and the rail 2 of FIG. 22 provided with a ferromagnetic rail magnet 22 in sectional representation along the section A-A.

FIG. 26 shows a carriage 1 according to the invention with a preferably formed carriage body 10, of which the end element 190 is held by a buffer 9. The carriage body 10 is formed in such a way that it optimally bundles the field lines of the inserted carriage magnets 12.

FIG. 27 shows the buffer of FIG. 26 which comprises an elastic buffer element 92 and a clamp 91, by means of which a parked separation element 3 can be held.

FIG. 28 shows a carriage 1 according to the invention with a carriage body 10 which is equipped with two rows of carriage magnets 12. The arrangement and also the formation of the carriage magnets 12 are not therefore in any way limited to the examples and can be optimised particularly in dependence upon the load and the rail and carriage dimensions, whereby symmetrical arrangements are preferred in relation to at least one main axis of the carriage 1.

FIG. 29 shows a segment of the rail 2 of FIG. 16 or FIG. 23 in a spatial representation.

FIG. 30 shows a segment of the rail 2 of FIG. 17 in a spatial representation. Here, the preferred arrangement of the receiving channel 210 for the rail magnets 2200 can be clearly seen. As said rail magnets 2200 absorb the largest proportion of the load, they are arranged close to the lateral elements of the rail 2; the running surfaces 2100 which absorb a much smaller load are inwardly offset. All in all the moment acting on each rail foot 21 is thereby reduced to a minimum.

FIG. 31 shows a carriage 1X according to the invention which only comprises a shaft 80 with two wheels 8 preferably supported by means of an elastic element 85, the carriage body 10X of which is connected on both sides by means of flange elements 106X and a preferably magnetic hinged bolt 120 in such a way to a respective single-axis carriage element 1Y that the carriage 1X which can be connected to the separation element 3 by means of a connecting screw 32 and the carriage elements 1Y are only rotatable against one another in one plane. The magnetic hinged bolt 120 is inserted preferably in the manner described for the carriage magnets 12 into a recess 1800 in the carriage body 10X or one of the flange elements 1060*x* thereof. Through the use of elastic elements 85 it is ensured that the load acting via the carriage 1X is evenly distributed over all chain members 1X, 1Y1, 1Y2, . . . and can be diverted by means of carriage magnets 12, 120 onto rail magnets 22, . . . . Additional carriage elements 1Y2, 1Y3 . . . can therefore be suspended on the carriage X1 on both sides as needed in dependence upon the load to be carried. On account of the jointed connection of the carriage 1X and the carriage elements 1, Y1, 1Y2, 1Y3, travel in bent rails 2 can be carried out.

FIG. 32 shows the carriage 1 of FIG. 1, in the carriage body 10 of which, as shown in FIG. 13, cylindrical carriage magnets 12 are embedded.

FIG. 33 shows the carriage 1 of FIG. 32 and a ferromagnetic rail magnet 22, in which hard-magnetic cylindrical carriage magnets 2212 are embedded. The technologies according to the invention which have been described above can therefore be combined. When applying this solution the carriage is additionally automatically centred.

FIG. 31 shows the known carriage 100 discussed above.

The invention has been described with the aid of exemplary embodiments. With the aid of the disclosed teaching of the invention further embodiments of the invention can be competently realised by those skilled in the art. In particular, further different types of mechanical support can be realised. For example sliding and rolling elements can also be used in combination. As shown schematically in FIG. 11, the load can be partially absorbed by means of sliding elements 11 while rolling elements 800 are responsible for the guiding around curves.

Furthermore, the shapes, layouts, materials and positioning of the recesses 18 and the carriage magnets 12 may be selected so as to deviate from the exemplary embodiments.

A combination of different magnetic forces can also be particularly advantageously used. For example a carriage 1 can be pulled upwards by a first rail magnet 22, 220, . . . and simultaneously pushed upwards by second rail magnets 2200.

Literature

[1] DE 40 16 948 A1

[2] US 2003/0110696 A1

[3] GB 1 089 605 A

[4] EP 1 197 624 A1

LIST OF REFERENCE NUMERALS FOR THE DEVICE ACCORDING TO THE INVENTION

1 Carriage
1A, 1B Coupled carriages 1
1X, 1Y Carriage elements
10 Carriage body, flux return plate
10X, 10Y Bodies of the carriage elements 1X, 1Y
10A, 10B Parts of the two-part carriage body 10
10C Adjusting screws for the two-part carriage body 10
10L, 10R Possibly inclined edge regions of the lower side of the carriage body 10
10M Central region of the lower side of the carriage body 10
100 Upper side of the carriage body 10
10U Lower side of the carriage body 10
100 Coupling element for the carriages 1A, 1B
101, 102 Bearing elements for the coupling element 100
104 Induction magnet
105 Intermediate flange
1050 Opening in the intermediate flange 105
106 Double flange
1060 Openings in the double flange
11 Sliding elements connected to the carriage 1
110 Sliding element connected to the carriage 1
111 Lateral contact zones of the sliding element 110
113 Opening in the sliding element 110 for passing through the connecting screw 32
118 Opening in the sliding element 110 for passing through a carriage magnet 12L; 12R
12, 12' Carriage magnet
12L, 12R Carriage magnet on the lower sides 10, 10*b* of the carriage body 10
120 Coupling element or carriage coupling magnet
129 Buffer magnet on the terminating element 190
13 Threaded bore in the carriage body 10
130 Bore in the carriage body 10 for receiving the shaft 80 and possibly the damping element 85
14 Induction magnet in the carriage 1
15 Carriage coil
16 Groove channels for receiving the sliding elements 11
18 Recess for a carriage magnet 12
180, 800 Recesses for screw or hinged bolts
181 Through channel in the recess 18
182 Base of the recess 18
185 Screw bolts in the recess 180
1850 Refined end element of the screw bolt 185
188 Annular bore
19 Flange elements on the carriage body 10
190 Terminating element
191 Elastic intermediate buffer
2 Rail for receiving the carriage 1
2' Rail central part
2" Rail lateral parts
21 Sliding ribs, rail foot
210 Receiving channel
2100 Sliding surfaces or running surfaces
22, 22', 22" Ferromagnetic, possibly soft or hard-magnetic rail magnet 2
220, 220' Plastic-bonded, elastic and strip-form rail magnet with and without hard-magnetic segments
2200A, B Assembled rail magnet in the rail foot
2200A', B' Plastic-bonded rail magnet in the rail foot 21
2210 flux return body of the assembled rail magnet 2200A, 2200B
2212 Hard magnet for the flux return body 2210
2218 Receiving opening in the flux return body 2210
23 Guide magnet
24 Induction magnet in the rail
25 Rail coil
27*a* First recess in the rail for fitting the second magnetic elements 22, 22'
27*b* Second recesses in the rail for fitting the lateral rail magnets 23
28 Retaining rib
280 Locking element
29 Gap, filled or unfilled
290 Diamagnetic material
3 Separation element such as sliding door or window
31 Assembly device
32 Connecting screw
5 Control device
50 Control unit
50*a* Controllable switch
50*b* Controllable resistor
50*c* Display unit, warning signal
50*d* Loud speaker
50*e* Electric lock
50*f* Electro-mechanical braking device
50*g* Electro-mechanical driving device
50*h* Antenna
50*i* Input unit, distance measuring device
51 Diode
52 Accumulator
500 Memory with control data
501 Sending/receiving device
5000 External power supply
5001 Control unit
8, 800 Wheel, roller; guide roller
80 Shaft for the wheels 8
81 Guide part of the wheel 8
82 Rolling part of the wheel 8
85 Damping element
9 Buffer
91 Clamp part
92 Buffer part

The invention claimed is:

1. A support device for a displaceable separation element that is guided along a rail having at least a center portion, two lateral portions, each of said lateral portions having a foot portion coupled thereto distally from said center portion, the device comprising:

at least one magnetic or ferromagnetic rail element that is coupled to said rail;

at least one carriage that is coupled to said separation element and that is guided by said rail;

said carriage comprising:

at least two mechanical support elements coupled to the carriage, and mechanically supported by a respective one of said foot portions;

a carriage body comprising ferromagnetic material, and further having:

a plurality of recesses on the side opposing the at least one rail element, each of said recesses is sunk into said ferromagnetic material and comprises a sunken base;

a plurality of carriage magnets each at least partially disposed in a respective recess, and contacting the sunken base of the respective recess the magnets being magnetically coupled to said ferromagnetic material of said carriage body; and to said rail element thus exerting a force therethrough for opposing the gravitational force exerted by said separation element.

2. A support device as claimed in claim 1, wherein said at least one carriage magnet or said at least one rail element consist at least partially of hard-magnetic material.

3. A support device as claimed in claim 1, wherein said at least one mechanical support element is a roller that is running on a foot portion of said rail and that is held by a shaft which is mounted on said carriage body.

4. A support device as claimed in claim 1, wherein said at least one mechanical support element is a sliding element.

5. A support device as claimed in claim 4, wherein said carriage body is provided on both sides with grooves, each groove containing one of said sliding elements that comprise a U-shaped profile designed to receive a foot portion of said rail.

6. A support device as claimed in claim 4, wherein said carriage body is mounted within an at least approximately U-profile-shaped sliding element which is seated on said foot portions of said rail.

7. A support device as claimed in claim 1, wherein the position of said carriage magnets within said recesses is adjustable.

8. A support device as claimed in claim 1, wherein said plurality of individual magnets are arranged such that an identical magnetic polarity points in the direction of said rail element.

9. A support device as claimed in claim 1, wherein said plurality of individual magnets are arranged such that the magnetic polarity of two adjacent magnets varies by about 90°, in the direction of said rail element.

10. A support device as claimed in claim 1, wherein a plurality of said carriage magnets are arranged on the top side of said carriage interacting with said at least one rail element that is arranged near said center portion of said rail.

11. A support device as claimed in claim 1, with said carriage having a bottom with two side edges, and wherein said carriage magnet comprises a plurality of individual magnets disposed on each of said edges, and cooperating with said at least one rail element disposed at respective foot portions of said rail.

12. A support device as claimed in claim 1, wherein the number of individual magnets is selected to provide a counter-force between 75-90% of the load exerted by said separation element.

13. A support device as claimed in claim 1, wherein said rail element is incorporated in a strip of flexible material.

14. A support device as claimed in claim 1, wherein said rail element is mechanically held within said rail or within said foot portions of said rail.

15. A support device as claimed in claim 1, further comprising:

at least a second carriage coupled to said first carriage;

said mechanical supports of each of said first and second carriages being equipped with two rollers on both sides;

wherein said first carriage and said second carriage are rotatable relative to each other in only a single plane.

16. A support device as claimed in claim 15, wherein said first carriage and said second carriage are coupled therebetween by flange elements extending therefrom.

17. A support device as claimed in claim 16, wherein said first and second carriage are coupled by a carriage magnet that is utilised as a hinge element.

18. A support device as claimed in claim 1, wherein said recesses in said carriage body are of a cylindrical form.

19. A support device as claimed in claim 1, wherein said carriage magnets are of a cylindrical form such as the form of a pill or tablet.

20. A support device as claimed in claim 1, wherein said carriage body comprises a threaded bore for receiving a connecting screw that is holding said separation element.

21. A support device as claimed in claim 1, wherein said rail is made of aluminum.

* * * * *